United States Patent [19]

Watterson et al.

[11] Patent Number: 5,067,710

[45] **Date of Patent: * Nov. 26, 1991**

[54] COMPUTERIZED EXERCISE MACHINE

[75] Inventors: Scott R. Watterson, Logan; George B. Bersonnet, River Heights; William T. Dalebout; Michael Burk, both of Logan, all of Utah

[73] Assignee: Proform Fitness Products, Inc., Logan, Utah

[ * ] Notice: The portion of the term of this patent subsequent to Mar. 12, 2008 has been disclaimed.

[21] Appl. No.: 415,160

[22] Filed: Sep. 29, 1989

Related U.S. Application Data

[63] Continuation-in-part of Ser. No. 306,872, Feb. 3, 1989, Pat. No. 4,998,725.

[51] Int. Cl.[5] ..... A63B 21/005

[52] U.S. Cl. ..... 272/129; 272/73; 272/DIG. 4; 272/DIG. 5; 272/DIG. 6; 73/379; 434/247

[58] Field of Search ..... 272/69, 70, 73, 129, 272/130, DIG. 4–DIG. 6; 128/25 R; 73/379; 434/247, 392

[56] References Cited

U.S. PATENT DOCUMENTS

| | | | |
|---|---|---|---|
| 4,278,095 | 7/1981 | Lapeyre | 272/69 X |
| 4,533,136 | 8/1985 | Smith et al. | 272/73 |
| 4,592,544 | 6/1986 | Smith et al. | 272/73 |
| 4,625,962 | 12/1986 | Street | 272/132 |
| 4,678,182 | 7/1987 | Nakao et al. | 272/73 |
| 4,708,337 | 11/1987 | Shyu | 272/69 |
| 4,770,411 | 9/1988 | Armstrong et al. | 272/73 |
| 4,790,528 | 12/1988 | Nakao et al. | 128/25 R X |
| 4,828,257 | 5/1989 | Dyer et al. | 272/129 |
| 4,832,332 | 5/1989 | Dumbser | 272/72 |

FOREIGN PATENT DOCUMENTS

| | | | |
|---|---|---|---|
| 0199442 | 10/1986 | European Pat. Off. | 272/134 |

*Primary Examiner*—Richard J. Apley
*Assistant Examiner*—Joe H. Cheng
*Attorney, Agent, or Firm*—Trask, Britt & Rossa

[57] ABSTRACT

A computerized exercise cycle is disclosed. The exercise cycle presents an exercise structure having a pair of pedals operable by a user against resistance provided by an adjustable resistance means. The resistance means is controlled by a computer which can be programmed by a user in a user-selected program of intensities to thus vary the resistance intensity over a programmed time duration. The exercise cycle is programmed to display an imaginary speed, a relative resistance level, a time counter or a countdown from a set time, a distance traveled, or a countdown from a set distance, and revolutions per minute. The computer also allows the user to select a target pulse value. The computer automatically adjusts the resistance to cause the user's pulse to approach the selected target pulse. The computerized cycle also allows the user to input background information such as weight, age and sex and to provide Caloric use information based on this background information, resistance values, and RPM's pedaled.

18 Claims, 18 Drawing Sheets

Fig. 2

COMPUTERIZED EXERCISE MACHINE

This application is a continuation-in-part of application Ser. No. 306,872 filed on Feb. 3, 1989, which is now U.S. Pat. No. 4,998,725.

BACKGROUND OF THE INVENTION

1. Field

The present invention is directed to an exercise machine and particularly one that is computerized.

2. State of the Art

Exercise machines such as stationary exercise cycles and treadmills are widely available and include a variety of features and operational controls. For example, exercise cycles typically include controls to vary the amount of resistance to the rotation of the pedals. A flywheel or other rotating mechanism offers an internal resistance to simulate what a user might experience if he were actually pedaling a bicycle on available terrain.

Treadmills typically include controls to vary the speed of the tread as well as some type of structure to vary the angle of inclination of the treadmill surface. Adjustments to the angle of inclination are made from time to time in order to regulate what may be viewed as the resistance or degree of difficulty of the exercise being performed by the user on the treadmill.

It appears generally accepted that an exercise program undertaken on a regular basis over a period of time is preferred over sporadic exercise. To improve the results from such a regular program, it is frequently desirable to perform the same exercises for longer periods of time or with differing degrees of difficulty. Combinations of difficulty and duration of selected exercises may be used to achieve desired goals of exercise conditioning.

Certain existing exercise machines, notably exercise cycles, are adapted to provide the user a set of selectable exercise routines from which the user may choose. Such routines are displayed typically in the form of a path along a terrain, with the path going uphill, along level ground, and downhill in various combinations. The user chooses from among the programs by looking at the depicted terrain patterns. Once the user has selected the particular terrain, he begins exercising and his "position" along the terrain is indicated typically by a light that "travels" along the terrain as time progresses. As the graphic display of terrain increases in angle, the amount of resistance offered to the pedaling is increased. As the terrain levels and then slopes downward, the resistance is decreased accordingly. These routines are pre-set by the manufacturer in terms of both their levels of difficulty and time duration.

It is currently believed that the pulse rate of the user is a substantial indicator of the level of exercise being undertaken and also an indicator of the amount of benefit being secured by the user. A lower pulse rate may indicate a lesser degree of conditioning to a user than a higher pulse rate. In addition, the user's Calorie burn rate while exercising or total Calorie use during a particular exercise session is considered to be an indicator of benefits derived by the user. Many users of exercise machines are interested in exercise for the purpose of weight loss. Users may be interested in knowing current Caloric use rate and total Calorie usage for that particular session of exercise.

A computerized exercise apparatus is therefore desirable to provide a program of exercise of varying difficulties and/or time durations. It would be highly desirable for such an exercise apparatus to be user programmable in terms of both resistance intensities and time durations. In addition, such an exercise apparatus would desirably monitor and display to the user actual metabolic data such as heart rate and Calorie use information. The Calorie use information would preferably be based upon actual user background information, such as the user's age, weight, and sex. Such an exercise apparatus would also additionally preferably include a means for automatically adjusting the resistance to cause the user to achieve a selected target metabolic condition, in terms of, for example, pulse rate.

SUMMARY OF THE INVENTION

The present invention provides a computerized exercise machine. An exercise structure is provided presenting a movable member adapted for movement by a user thereby to exercise on the exercise structure. Resistance means is associated with the movable member for offering resistance to the movement of the movable member. Adjustment means is mechanically associated with the resistance means for selectively varying the amount of resistance offered by the resistance means. Computer means is associatively linked with the adjustment means for selectively controlling the adjustment means. Input means is associatively linked with the computer means for receiving data from a user. The computer means is programmed to read a user-selected program at the input means including a series of intensities of resistance and to control the adjustment means in accordance with the program at the intensities over a preselected program duration.

In one embodiment, the computer means is further programmed to read the preselected program duration at the input means. In another embodiment, the computer means is further programmed to divide the program duration into a preselected number of time steps and to control the adjustment means to vary the resistance offered by the resistance means according to the user-selected program upon each change to a subsequent time step.

In another embodiment, the exercise machine further comprises metabolic data input means associatively linked with the computer means for receiving metabolic data from a user exercising on the exercise machine. The computer means is programmed to read metabolic data from the metabolic data input means, read target metabolic data from the input means and to compute a projected resistance intensity to cause metabolic values of a user exercising on the exercise structure to approach the target metabolic data. The computer is also programmed to control the adjustment means to change the resistance offered by the resistance means to the projected resistance intensity.

In another embodiment, the exercise machine further comprises a motion sensor mounted to the exercise structure to sense the rate of movement of the movable member. The computer means is programmed to read background information about a user at the input means and to read the rate of movement of the movable member from the motion sensor. The computer is also programmed to read the intensity of resistance offered by the resistance means and to computer Calorie use information about the user based upon the background information, the rate of movement of the moveable member, and the intensity of resistance offered by the resistance means. Display means may be advantageously linked with the computer means for displaying the Calorie use information. In one embodiment, such Calorie use information includes total Calories used by the user while exercising on the exercise cycle. In another embodiment, the Calorie use information includes a Calorie use rate.

In another embodiment, the exercise machine further comprises resistance sensing means associated with the resistance means and communicatively linked with the computer means for sensing the resistance offered by the resistance means. This resistance sensing means may include a piezoelectric material adapted to deform upon changes to the amount of resistance offered by the resistance means and adapted to translate such deformation to an electrical signal. Preferably, the computer means is programmed to read resistance amounts from the resistance sensing means and to derive values for measured resistance intensities therefrom.

In another embodiment, the resistance means further comprises rotating means linked with the movable member for rotating in correspondence to the movement of the movable member. Loop means engages the rotating means for offering resistance to the rotating means. Preferably, the adjustment means includes a motor mounted to the exercise structure and electrically linked to the computer means. The motor is operable in either of two directions and mechanically linked to the loop means to increase or decrease the amount of resistance offered by the loop means to the rotation of the rotating member. In a highly preferred embodiment, the exercise structure is an exercise cycle.

BRIEF DESCRIPTION OF THE DRAWINGS

In the drawings, which illustrate what is currently regarded as the preferred embodiment.

DETAILED DESCRIPTION OF A PREFERRED EMBODIMENT

Figure 1:
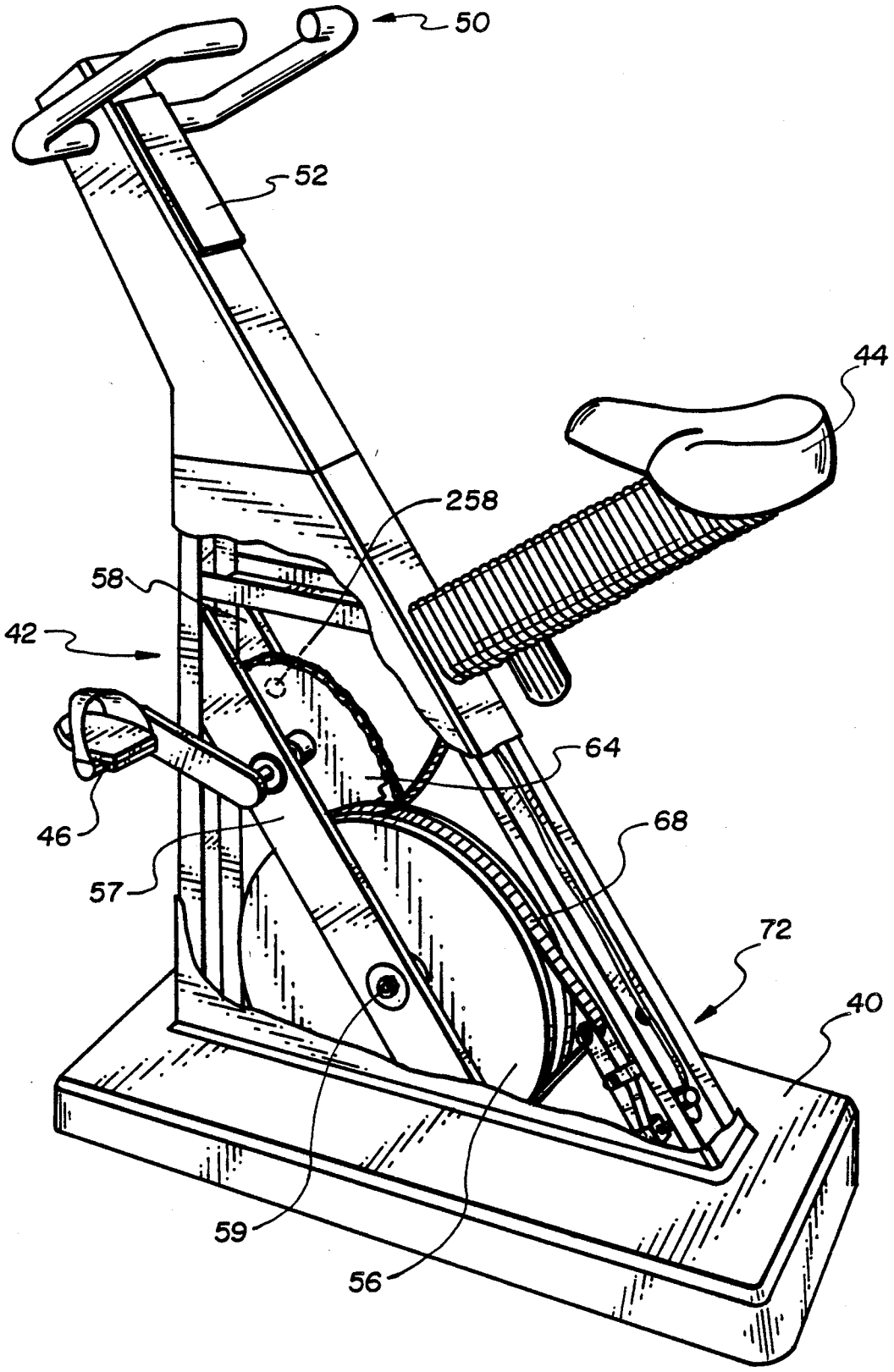
FIG. 1 is a perspective illustration of an exercise cycle of the invention.

Referring to FIG. 1, the illustrated exercise cycle includes a base 40, a frame generally indicated at 42, a seat 44, pedals 46 and 48 (see FIG. 2), and handle structure generally indicated at 50. A user seats himself upon seat 44, places his feet upon pedals 46 and 48, and grasps handle structure 50 with his hands. The user then rotates pedals 46 and 48 in the same manner as he would a bicycle to exercise upon the exercise apparatus of FIG. 1.

The exercise apparatus shown in FIG. 1 therefore provides exercise structure or a cycle structure presenting a pair of pedals to allow the user to engage in a pedaling motion to exercise upon the exercise apparatus. Pedals 46 and 48, and their associated components, constitute a movable member. The exercise which a user engages in by rotating pedals 46 and 48 in cycle fashion are an exercise movement. Other types of exercise structures are within contemplation. For example, exercise structure may be constituted by a treadmill such as that which is disclosed in the co-pending application Ser. No. 306,872, of which the present case is a continuation-in-part and the disclosure of which is incorporated herein by reference.

A rotating flywheel 56 is rotatably attached to brace members 57 and 58, which are formed as part of frame 42 by means of axle 59. Flywheel 56 is mechanically connected with pedals 46 and 48 by means of a sprocket 60 connected to a chain 62 and in turn to sprocket 64 (see FIG. 2). Rotation of pedals 46 and 48 therefore causes rotation of flywheel 56. Flywheel 56 constitutes a rotating member.

A strap 68 engages flywheel 56 and offers resistance to the rotation of flywheel 56. In the illustrated embodiment, strap 68 therefore forms an integral part of a resistance means for offering resistance to the rotation of flywheel 56.

An adjustment means generally indicated at 72 in FIG. 1 is included for varying the amount of resistance offered by the strap 68 to the rotation of flywheel 56. Adjustment means 72 is more clearly illustrated in FIGS. 2 and 3. This adjustment means includes a lever 76 which pivots about a fulcrum 78 mounted as shown to a bracket 79, which is in turn mounted to frame 42. Lever 76 engages with strap 68 at an axle 80.

A bidirectional motor 84 is also mounted as shown to frame 42. Lever 76 includes a bracket 86 in which is mounted a threaded nut 88. Bidirectional motor 84 is mechanically linked to a rotating shaft 90 by means of a gear down mechanism 92. Shaft 90 is threaded to engage with nut 88. Bidirectional motor 84 is electrically linked to the control circuitry shown in FIG. 5 by means of electrical wires 96. The control circuitry of FIG. 5 includes a microprocessor which is programmed to control motor 84 in either of its two directions.

When motor 84 is energized in one direction, by means of gear down assembly 92, shaft 90 is caused to rotate and to therefore urge motion of nut 88 and bracket 86 in one of the directions marked by the double arrow 98. When bidirectional motor 84 rotates in the other direction, this same assembly causes nut 88 and bracket 86 to be urged in the other of the directions marked by double arrow 98. When bracket 86 moves in one of these two directions, lever 76 acts as a lever arm against the tension of strap 68 by moving axle 80 in one of the directions marked by arrows 102 or 104 in FIG. 3. When pulley 102 is caused to move in direction of arrow 102, tension is increased upon strap 68, and thereby the resistance is increased to the rotation of flywheel 56. When pulley 80 is caused to move in the direction of arrow 104 shown in FIG. 3, tension on strap 68 is decreased and the resistance to the rotational motion of flywheel 56 is decreased.

Figure 2:
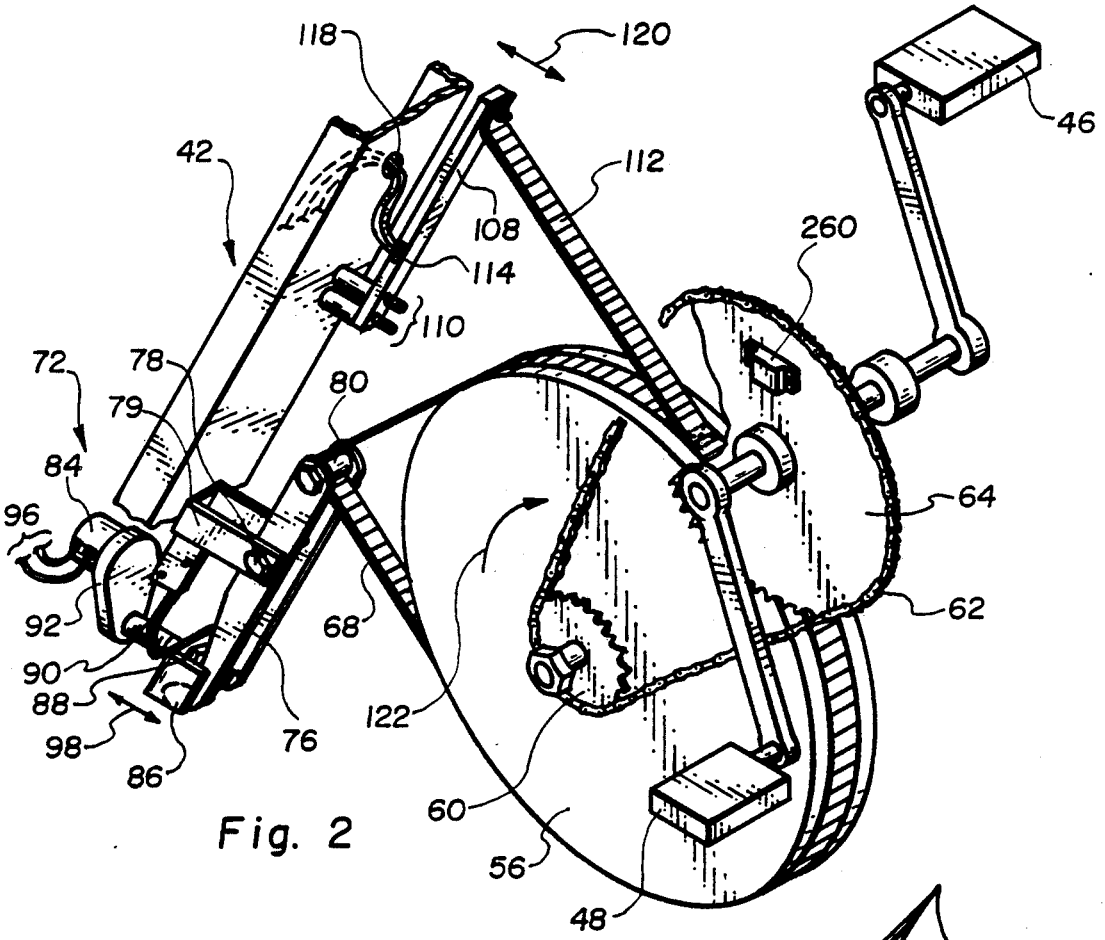
FIG. 2 is a perspective partial cut-away view of a resistance mechanism of the invention.

Referring to FIG. 2, a bar 108 of resilient material, preferably spring steel, is mounted by means of a post assembly 110 to frame 42, as shown. Bar 108 is attached by means of a flap or appendage 112 to strap 68. A piezoelectric transducer 114 is mounted to bar 108. Transducer 114 is connected by means of wires 118 to the control circuitry shown in FIG. 5. The association between bar 108 and piezoelectric transducer 114 constitute a strain gauge. When bar 108 is deformed in either of the directions indicated by double arrow 120, transducer 114 generates an electrical signal proportional to the amount of deformation in bar 108. Transducer 114 itself deforms to generate the electrical signal.

When a user is exercising on the exercise cycle, flywheel 56 rotates in the direction represented by arrow 122. If motor 84 is energized in a first direction to cause axle 80 to move in direction 102 (FIG. 3), the resistance between strap 68 and flywheel 56 is increased. As the resistance between strap 68 and flywheel 56 increases, flywheel 56 exerts a greater amount of pulling force on flap 112 and bar 108. In other words, as the resistance increases between strap 68 and flywheel 56, strap 68 pulls flap 112 and hence bar 108 toward flywheel 56. As the pulling force on bar 108 increases in proportional amounts, the electrical signal generated by transducer 114 increases. Bar 108, flap 112 and transducer 114 therefore are included as important elements of an illustrated resistance sensing means. Other resistance sensing means are within contemplation. For example, some mechanism may be associated with lever 76 to sense the amount of motion of lever 76 caused by motor 84, and to therefore translate such motion into an appropriate resistance level.

Figure 3:
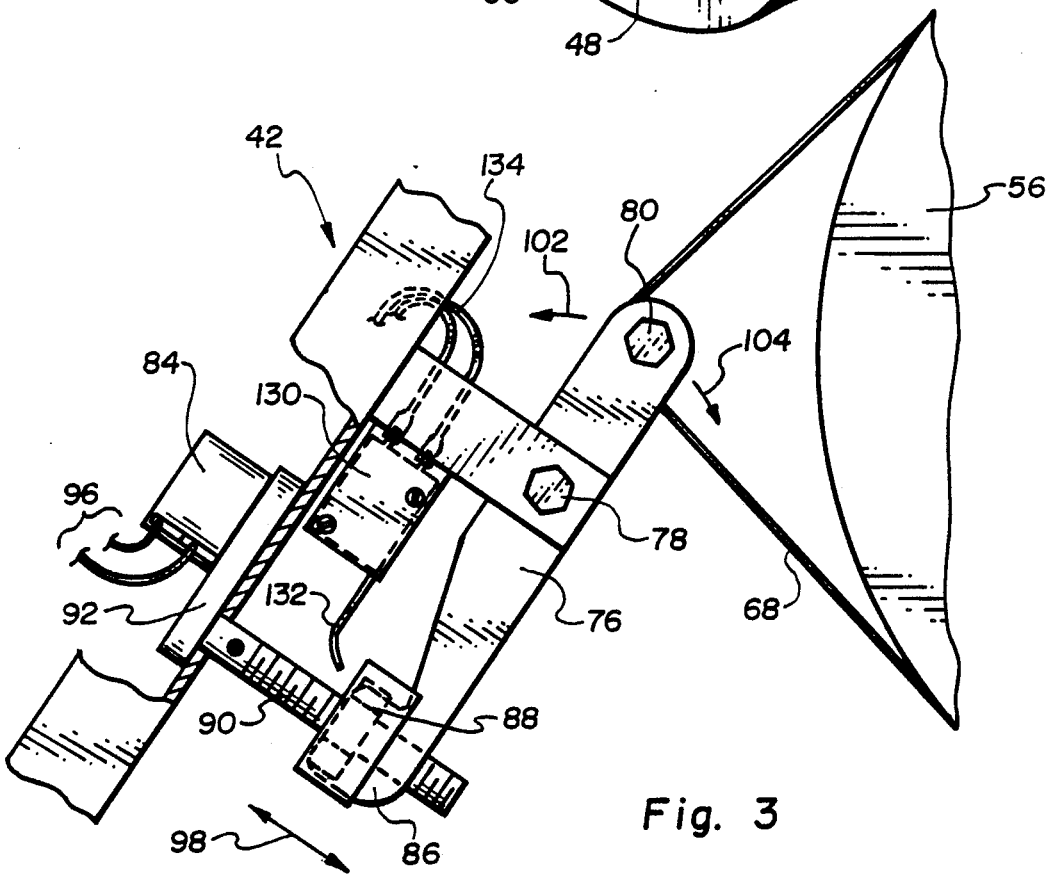
FIG. 3 is a side view of a resistance mechanism of the invention including a limit switch.

Referring to FIG. 3, a limit switch 130 is attached to frame 42 as shown, and includes a finger-like extension 132. Finger-like extension 132 is positioned such that at a certain point of travel, bracket 86 will interfere with extension 132. This interference is designed to occur at a point when, because of the position of lever 76, the resistance between strap 68 and flywheel 56 is at a minimum, which is defined to be the zero resistance level. When bracket 86 interferes with extension 32, an electrical signal is generated within switch 130. Switch 130 is connected by means of wires 134 to the control circuitry illustrated in FIG. 5.

Figure 4:
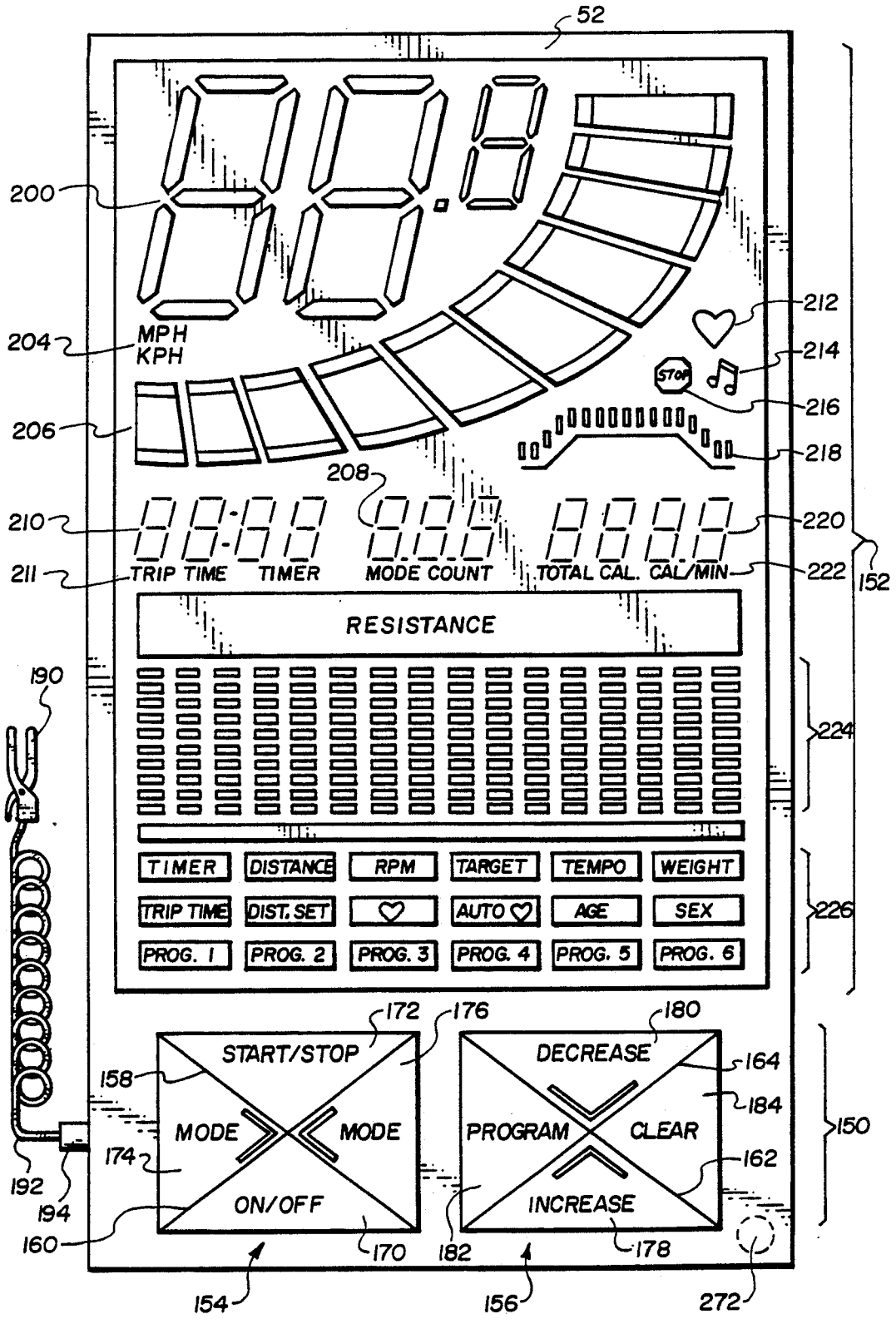
FIG. 4 is a depiction of the front view of a control panel of the invention.
Figure 5:
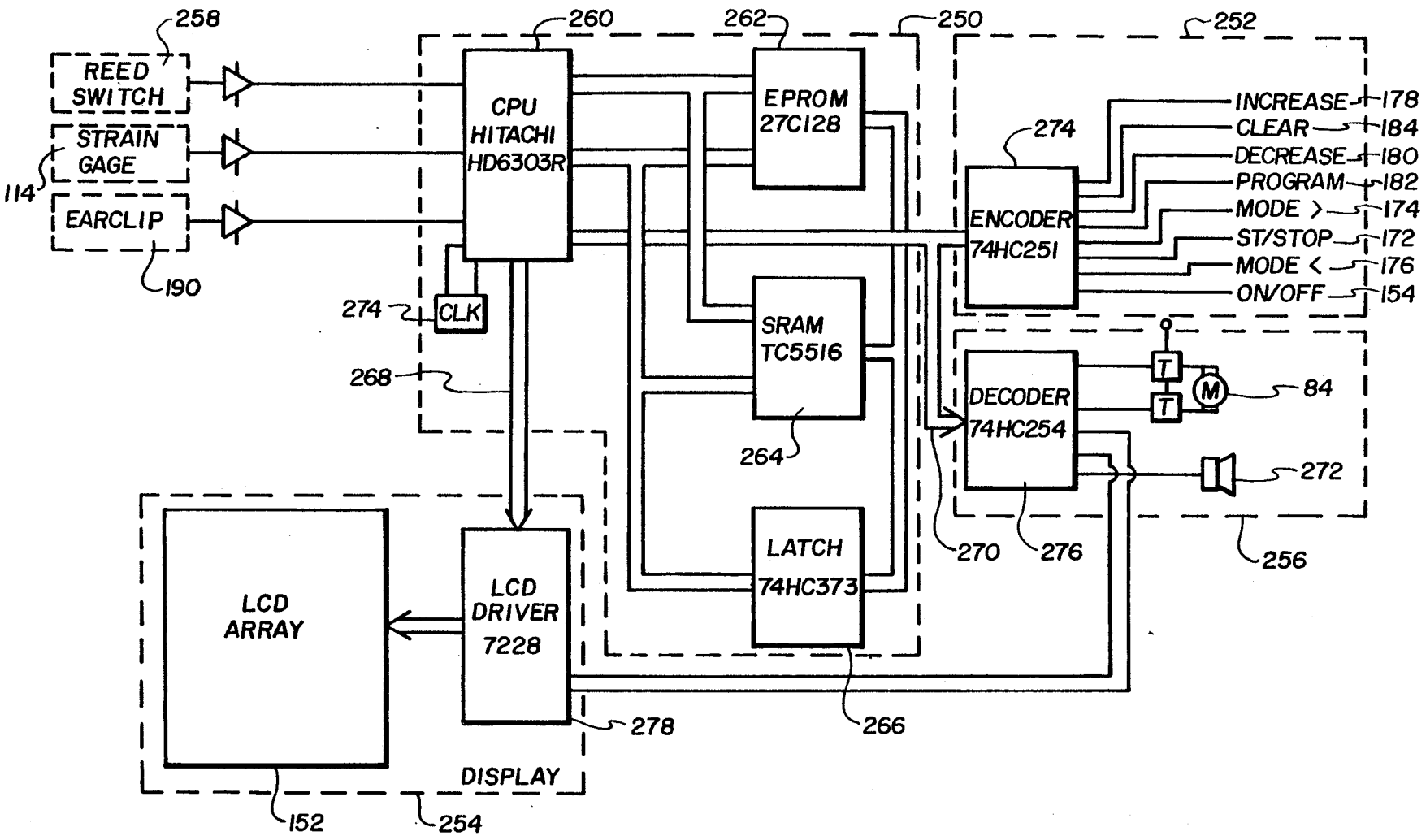
FIG. 5 is a block schematic diagram of control circuitry of the invention.

A front view of control panel 52 is illustrated in FIG. 4. The control circuitry illustrated in FIG. 5 is attached behind and electrically linked with panel 52. The control circuitry illustrated in FIG. 5 is the "brain" which interacts with this panel and includes a computer, or computer means. Panel 52 is divided into two general sections, keypad 150 and LCD array 152. Keypad 150 includes keys 154 and 156. Key 154 and 156 are biaxle switches. Key 154 rotates around a first axis 158 and around a second axis 160. Switch 156 rotates around a first axis 162 and around a second axis 164. With each key having these two axes of rotation, it can be seen that keys 154 and 156 are each divided into four triangular quadrants. Keys 154 and 156 are designed such that if one of the four quadrants is depressed by a user somewhere in the center area of any one of the triangular quadrants, a specific electrical signal is generated within the key corresponding to that selected quadrant. Therefore, each of these quadrants may be referred to as a button. As shown, key 154 includes on/off button 170, start/stop button 172, mode increase button 174, and mode decrease button 176. Key 156 includes increase button 178, decrease button 180, program button 182, and clear button 184. Buttons 170 through 184 are electrically connected to the control circuitry of FIG. 5. Buttons 170 through 184 constitute various input means by which a user may transmit data or information to the computer of FIG. 5.

Another data input means is constituted by ear clip 190 which may be attached to the ear lobe of a user. Ear clip 190 is electrically connected via cord 192 through jack 194 to the computer of FIG. 5. Ear clip 190 is constructed in a manner to sense a user's pulse through his ear lobe and to generate an electrical signal corresponding to such pulse.

LCD display 152 includes various fields of visual indicators. These fields are: a speed indicator 200, mile per hour and kilometer per hour indicators 204, resistance indicator 206, mode count display 208, time display 210, trip time/timer indicators 211, flashing pulse indicator 212, tone function indicator 214, stop indicator 216, plateau display 218, Calorie display 220, total Calories and Calorie per minute indicators 222, program matrix display 224, and function indicators 226. These fields are electrically connected to the computer of FIG. 5 and are associatively to function in a manner described hereinafter.

Speed display 200 displays the speed a user would be traveling on natural terrain if the exercise cycle were a standard bicycle. The speed indicated in field 200 has a range from between 00.0 to 99.9 units of distance per time. In field 204, if the mile per hour indicator is lit, the speed in field 200 is shown in miles per hour; if the kilometer per hour is lit, the speed in field 200 is displayed in kilometers per hour.

In field 206, the relative resistance offered to the pedaling of the pedals 46 and 48 of FIGS. 1 and 2 is shown. This resistance may vary from between a level indicated as level 1 to as much as level 10, being the maximum resistance. As can be seen, field 206 is divided into ten separate arced shapes. When the smallest arc shape near field 204 is lit, level 1 is indicated. As the resistance increases, more of the arc-shaped subfields are lit progressively towards the right and upper corner of panel 52 to graphically indicate the relative resistance being encountered.

Field 208 displays values selected in the DISTANCE, DISTANCE SET, RPM, and PULSE functions described hereafter. Field 208 is also used to display values entered in the TARGET PULSE, AUTO PULSE, and TEMPO functions described hereafter. In addition, field 208 is used to enter the user's age and weight into the computer, in the BACKGROUND mode described hereafter. Field 210 displays times used in the TIMER and TRIP TIME functions described hereafter. The range of values for field 210 are from 00:00 to 99:99 displayed in minutes:seconds. Field 211 indicates whether the TRIP TIME or TIMER function has been selected.

Field 212, which is a heart-shaped LCD indicator, is used to flash in time with the user's pulse when ear clip 190 is used. Tone indicator 214 lights when a function utilizing a tone has been selected and when the computer is in the stopped mode. Stop indicator 216 lights whenever the computer is in the stopped mode. Plateau display 218 is used in the TARGET PULSE and AUTO PULSE functions described hereafter. Calorie display 220 displays values for the TOTAL CALORIES and the CALORIES PER MINUTE functions described hereafter. Function indicators 222 indicate whether TOTAL CALORIE or CALORIE PER MINUTE functions have been selected. Program matrix display 224 displays resistance intensities for program functions 1 through 6. Each vertical column of bars in field 224 represents a pedal resistance level between 1 and 10. The farthest left column indicates the current level, and the entire display moves to the left as the user progresses through the selected program. This display is also used to show an M or an F when the sex of the user is entered into the computer during the background mode described hereafter. Field 226 includes function indicators which light to indicate functions selected for display.

FIG. 5 is a schematic block diagram of control circuitry of the invention. Major components of this control circuitry are indicated within dotted lines, as shown. This control circuitry includes a computer 250, input system 252, display system 254, and driver circuit 256. The computer 250 is the "brain" of the exercise cycle and includes the software or programming to cause the cycle in response to data such as input received from the user, data received from the cycle itself, and metabolic data such as the user's pulse rate.

Through the input system 252, the user accesses computer 250 to input various commands and data, which may in part be in response to prompts or messages given by the computer to the user. Computer 250 gives visual messages to the user by means of display system 254. Computer 250 provides commands to activate mechanical elements of the exercise cycle, such as motors and speakers, by means of driver circuit 256. As also shown, computer 250 is electrically linked to receive or to read information from strain gauge 114, ear clip 190, and from a reed switch 258 (described hereafter), which computer 250 uses to derive the pedaling speed of the exercise cycle.

Those skilled in the art will recognized computer 250 as incorporating a microprocessor, which is a control device that is well known and widely used for controlling electromechanical devices. Computer 250 includes a central processing unit (CPU) 260, an erasable programmable memory (EPROM) 262, and a static random access memory (SRAM) 264. Computer 250 also includes a latch circuit 266 to lock certain values or to latch them during the course of operation as will be understood by those skilled in the art.

CPU 260 is interconnected with EPROM 262, SRAM 264 and latch 266 in order to receive signals, process them, and in turn generate and transmit signals via conductor or line 268 to the display system 254 to thereby provide visual messages to a user. Signals are also provided via conductor or line 270 to driver circuit 256 to activate or control mechanical aspects of the exercise cycle. As shown, driver circuit 256 controls bidirectional motor 84 and a speaker 272, which is mounted behind LCD array 152. Computer 250 transmits auditory signals to a user by means of speaker 272. Computer 250 also includes a clock 274 which CPU 260 addresses to calculate various time-based functions essential to the functioning of the computer as is well known by those skilled in the art.

Reed switch 258 is mounted to frame 42 (FIG. 1, shown in phantom). A sensing magnet 260 is attached to sprocket 64. Sensor magnet 260 is positioned so that upon each rotation of sprocket 64, sensor magnet triggers reed switch 258 to in turn provide an electrical signal to CPU 260. Based on these electrical signals, CPU 260 computes a rotational speed for sprocket 64, and in turn pedals 46 and 48, in terms of revolutions per minute. Reed switch 258 and sensor magnet 260 constitute an illustrated embodiment of a movement sensor or a movement sensing means. Other systems and mechanisms are within contemplation for sensing movement of various exercise machines depending upon the type of movable member which is moved by a user to engage in exercises.

As shown, input system 252 includes an encoder 274 which is linked to the various buttons of keys 154 and 156, specifically increase button 178, clear button 184, decrease button 180, program button 182, mode increase button 174, start/stop button 172, mode decrease button 176, and on/off button 154. Encoder 274 receives signals from these buttons when they are depressed and transmits to CPU 260 a signal corresponding to which of the buttons has been depressed.

Driver circuit 256 includes a decoder 276 linked, as shown, to bidirectional motor 84 and to speaker 272. Based upon signals decoder 276 receives from CPU 260 via line 270, decoder 276 provides signals to motor 84 or to speaker 272 to activate these devices. Motor 84 can be activated in either of two directions according to signals provided by decoder 276. Display system 254 includes an LCD driver 278 and LCD array 152. Based upon signals LCD driver 278 receives from CPU 260 via line 268, driver 278 energizes LCD array 52 to provide messages or prompts in one or more of the various fields of LCD array 152.

The programming of computer 250 is described in reference to FIGS. 6 through 21, which include flowcharts of programming for computer 250. In these flowcharts, a diamond-shaped box represents a test or question performed by the computer. A rectangular box represents other program steps. Of course, a single box may represent several actual program lines in a written program. Numbered program tests and steps are indicated herein in parentheses. A description of the exercise cycle is made in conjunction with a description of the programming contained in FIGS. 6 through 21.

Figure 6:
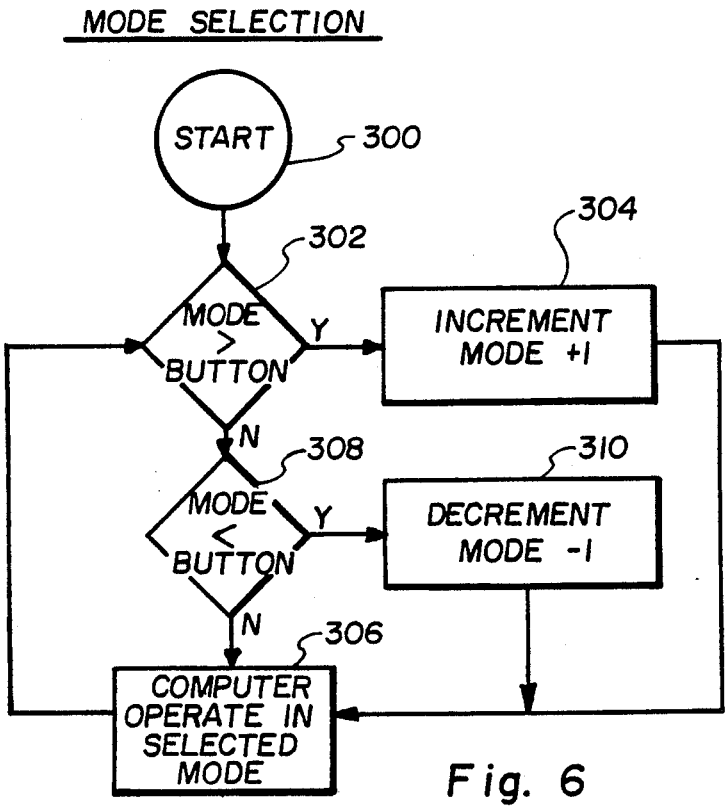
FIG. 6 is a flowchart of a mode selection program of the invention.

Referring to FIG. 6, a MODE SELECTION program is depicted. This program allows the user to select between modes described more completely hereafter. The user begins the program by depressing "on/off" button 170 to start the program (300). The computer asks if the mode increase button has been depressed (302). If so, the computer increments the mode number by 1 (304), and operates in the selected mode (306). These selected modes are described hereafter. If the answer at test (302) is "no," the computer runs another test to ask if the mode decrease button has been depressed (308). If the answer is "yes," the computer decreases the mode number by 1 (310) and then allows the computer to operate in the selected mode (306).

When the program has reached step (306), one of the displays in LCD array 152 is lit to indicate the selected mode. The computer will then operate in this mode until a mode selection is again made to increase or decrease the mode. This function is described more completely hereinafter. A dotted line is shown from step (306) back to step (302) to indicate that the program maintains the status quo operating in the selected mode, but that the program continues to look for whether mode increase button 174 or mode decrease button 176 have been pressed. If a mode has previously been selected, when the program decreases the mode number by one, the program then operates in the highest mode, so that the program provides a continuous loop of modes. This allows the user to quickly select among modes by either depressing the mode increase button 174 or mode decrease button 176.

Figure 7:
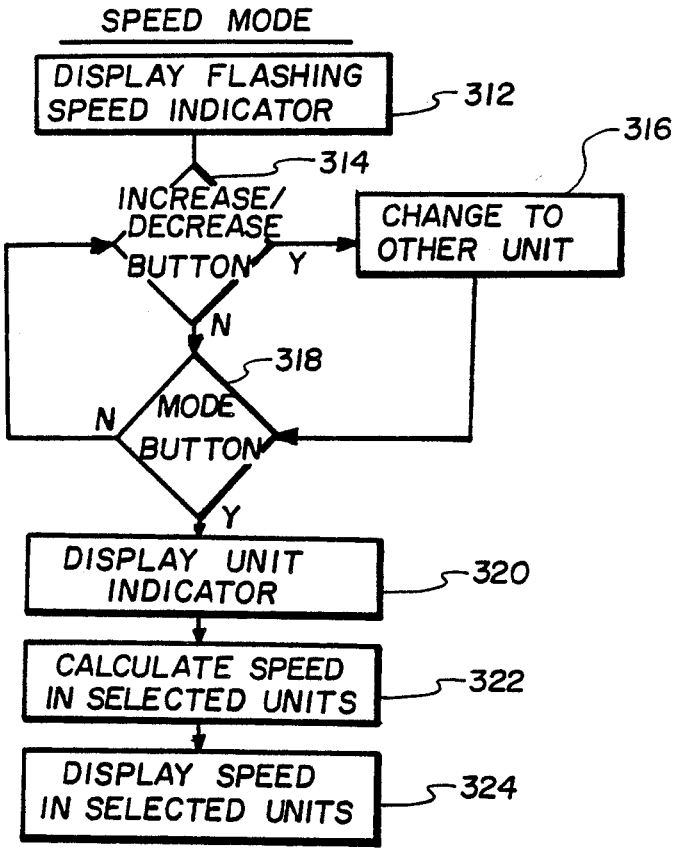
FIG. 7 is a flowchart of a SPEED mode program of the invention.

FIG. 7 illustrates a program flowchart for the SPEED mode, which allows for speed selection in terms of the units in which field 200 depicts the calculated speed that a user would be traveling if he were riding a bicycle on natural terrain. The computer calculates this speed based on RPM data received from reed switch 258. The speed is displayed whenever the pedals are turning. No keys need to be pressed to select this function.

When the computer has been recently turned on, the speed is displayed in miles per hour in field 200 and the "MPH" indicator in field 204 is lit. If, however, the user desires to change the units, he presses either the mode increase button 174 or mode decrease button 176 until either the "MPH" or "KPH" indicator flashes, as indicated at step (312). At this time, the computer asks whether either the increase button 178 or decrease button 180 has been pressed (314). If the answer is "yes," the computer changes to the other unit which is not flashing (316). After (316), or if the answer to test 314 is "no," the computer asks if a mode button 174 or 176 has been pressed (318). If the answer is "no," the computer stays in status quo and continues to ask itself whether the increase or decrease buttons 178 or 180 have been pressed, and if so, the program will react as described. If the answer is "yes," the computer displays the selected unit indicator in a non-flashing mode, i.e., either the "MPH" or the "KPH" indicators in field 204 (320). The computer then calculates the speed in the selected unit of speed measurement (322). The computer then displays the speed in the selected unit in display 200 (324).

Figure 8:
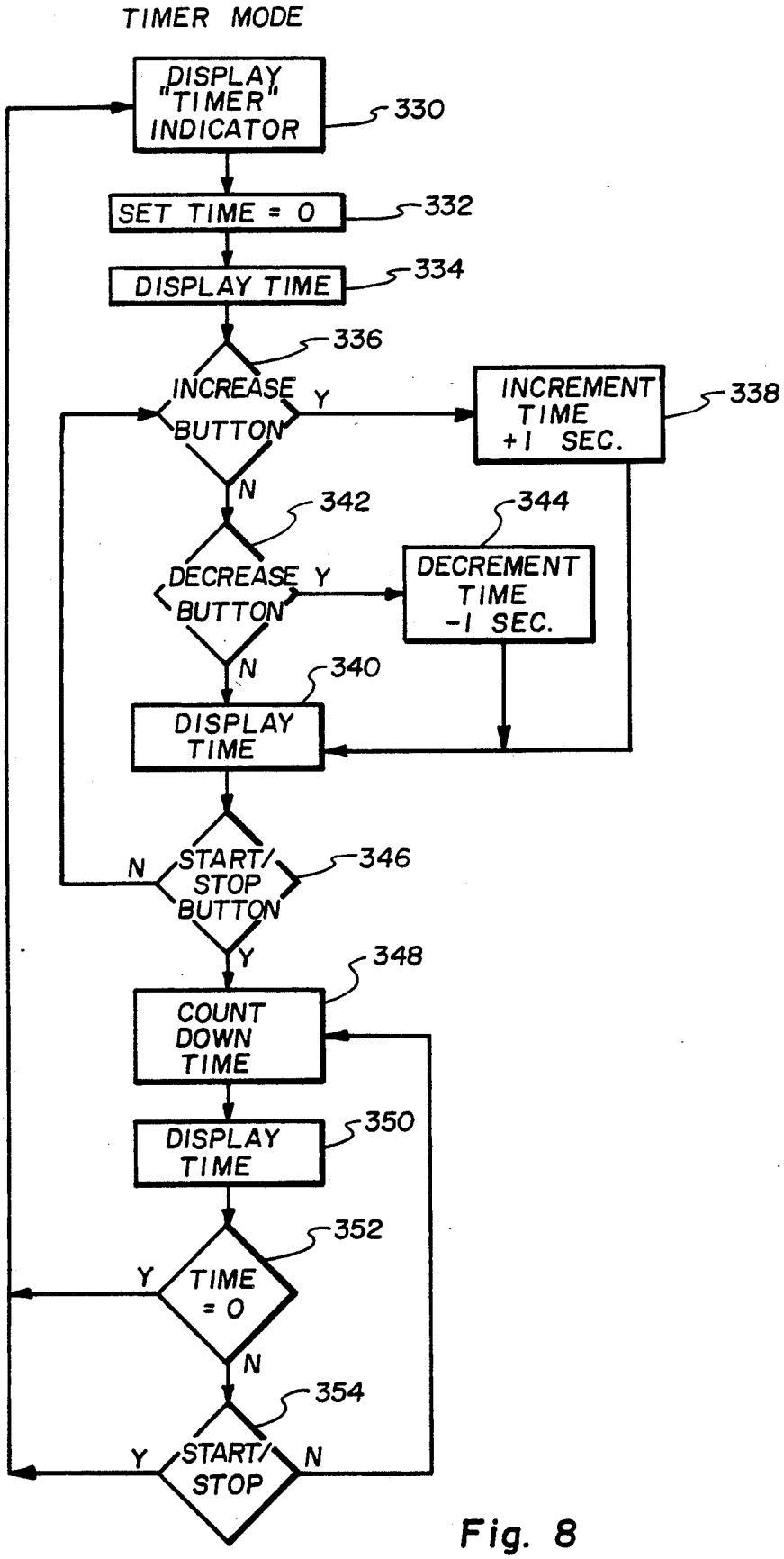
FIG. 8 is a flowchart of a TIMER MODE program of the invention.

FIG. 8 illustrates a block diagram of a program for a TIMER mode. To get into this mode, the user has depressed either the mode increase or mode decrease buttons 174 or 176 until the "timer" indicator in field 211 is lit (330). The computer sets an internal time function at 0 (332) and then displays this time (334) in field 210. The computer asks if increase button 178 has been pressed (336). If the answer is "yes," the computer increments the time set in the amount of one second (338) and displays the new time again in field 210 (240). If the answer to test 336 is "no," the computer asks if the decrease button has been pressed (342). If the answer is "yes," the computer decreases the time by one second (344) and displays the new time (240).

The computer then asks if the start/stop button has been pressed (346). If the answer is "no," the computer retains the status quo in terms of the time displayed in field 210, but continues to ask itself whether the increase button or decrease button have been pressed. If the answer is "yes," the computer begins to count down time from the display time most recently shown in field 210 (348). The computer then displays this counted down time (350). The computer asks itself whether the time equals 0 (352). If the answer is "yes," the computer returns to step 330 to again display the "timer" indicator. If the answer is "no," the computer asks itself whether the "start/stop" button has been pressed (354). If the answer is "yes," the computer again displays the "timer" indicator (330). If the answer is "no," the computer continues to go through the time display of steps 348 and 350 and continues to ask itself if the time equals 0 (352).

Figure 9:
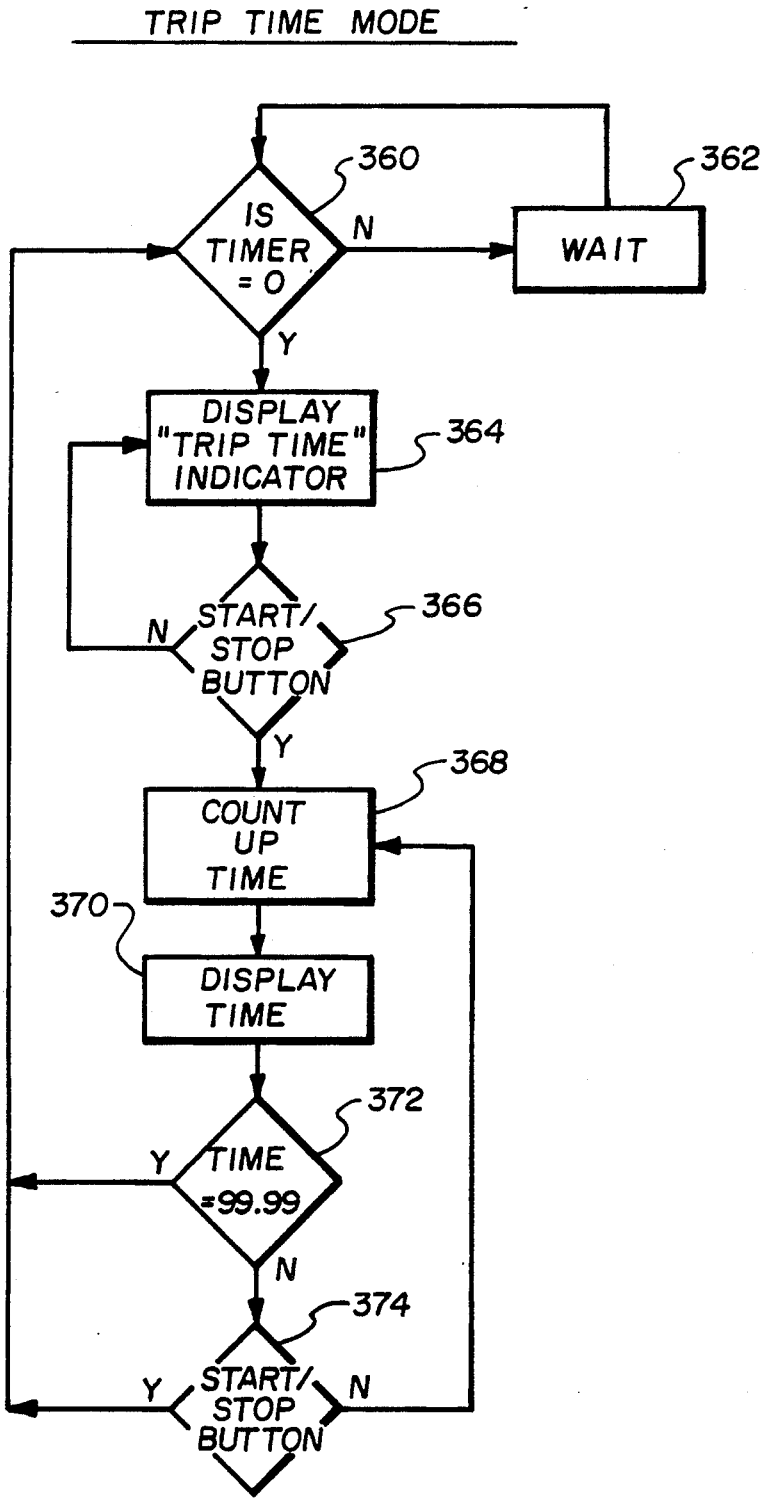
FIG. 9 is a flowchart of a TRIP TIME mode program of the invention.

FIG. 9 depicts a program for a TRIP TIME mode. This mode begins by the computer asking itself if the timer in field 220 equals 0, in other words, if the timer mode has completed counting down to 0 (360). If the answer is "no," the computer continues to wait (362) and ask itself if the timer is equal to 0. If the answer is "yes," the computer lights the "trip time" indicator in field 211 (364). The computer then asks itself if the "start/stop" button has been pressed (366). If the answer is "no," the computer maintains the status quo by continuing to display the trip time indicator and continues to ask itself if the "start/stop" button has been depressed. If the answer is "yes," the computer begins to count up time (368) and to display the time in a standard clock timer fashion in field 210 (370). The computer then asks itself if the time in field 210 equals 99 minutes and 99 seconds (372). If the answer is "yes," the computer returns to test 360. If the answer is "no," the computer asks itself if the "start/stop" button has been pressed (374). If the answer to this question is "yes," the computer returns to test 360. If the answer is "no," the computer continues to count up time and to display the time (368 and 370) and to ask itself if the time is 99 minutes and 99 seconds (372).

Figure 10:
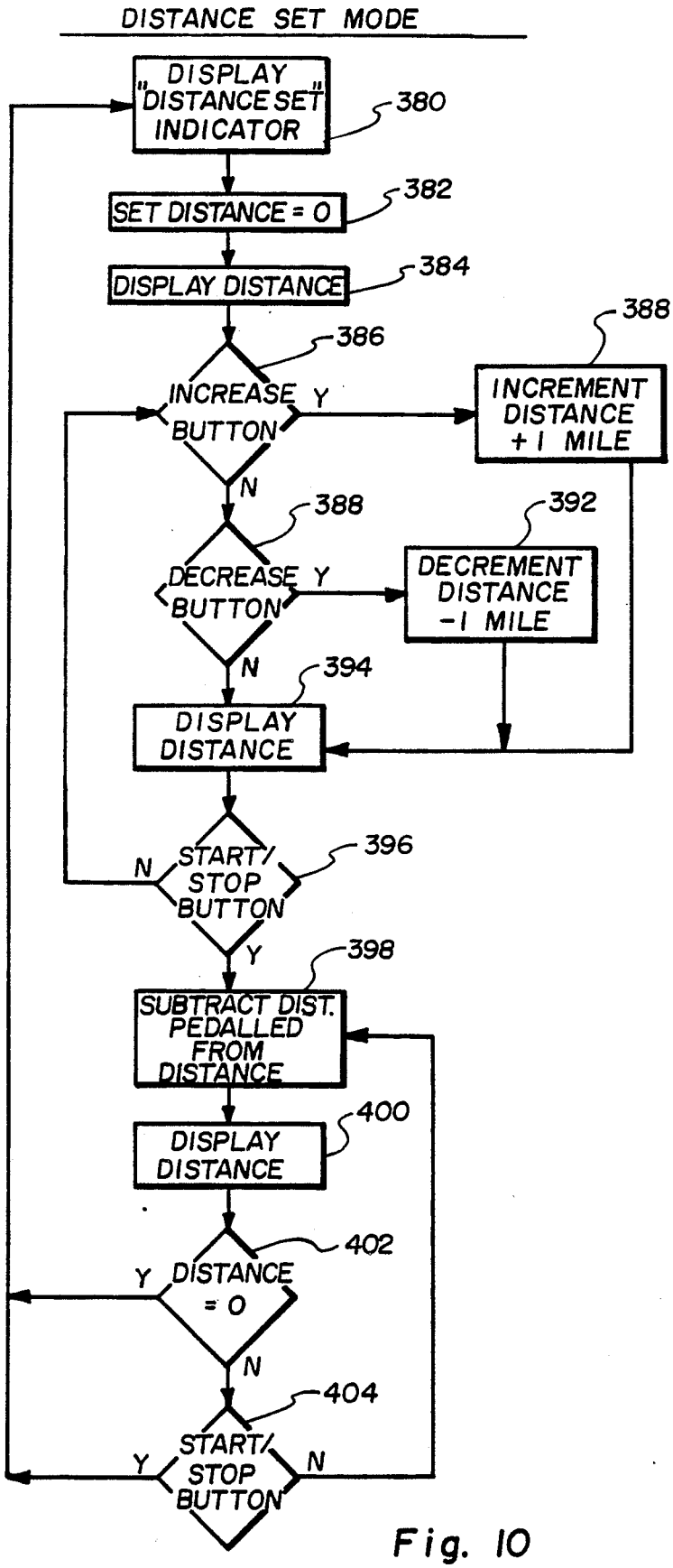
FIG. 10 is a flowchart of a DISTANCE SET mode program of the invention.

FIG. 10 depicts a program for the DISTANCE SET mode. The program displays the "distance set" indicator in field 226 (380), sets an internal distance at 0 (382), and displays this 0 distance in field 208 (384). The computer the asks itself whether increase or decrease buttons 178 or 180 are pressed to increment or decrement this internal distance according to the selection of the user and to display the selected distance at field 208 (386, 388, 390, 392, and 394). The computer then asks itself whether the "start/stop" button has been pressed (396). If the answer is "no," the computer remains in the status quo but continues to allow the user to increase or decrease the selected distance displayed at field 208.

If the answer to test 396 is "yes," the computer begins to subtract the distance the user has actually pedaled from the distance set (398). The computer calculates this distance, which is a fictional distance based on RPM data read from reed switch 258. After subtracting the distance pedaled from the distance set, the computer displays the remaining distance to be pedaled at field 208 (400). The computer then asks itself whether the distance has counted down to 0 (402) or whether the "start/stop" button has again been pressed (404). If either of these events occur, the computer returns to step 380. If the "start/stop" button has not been pressed, the computer continues to subtract the distance pedaled and to display the remaining distance in field 208.

Figure 11:
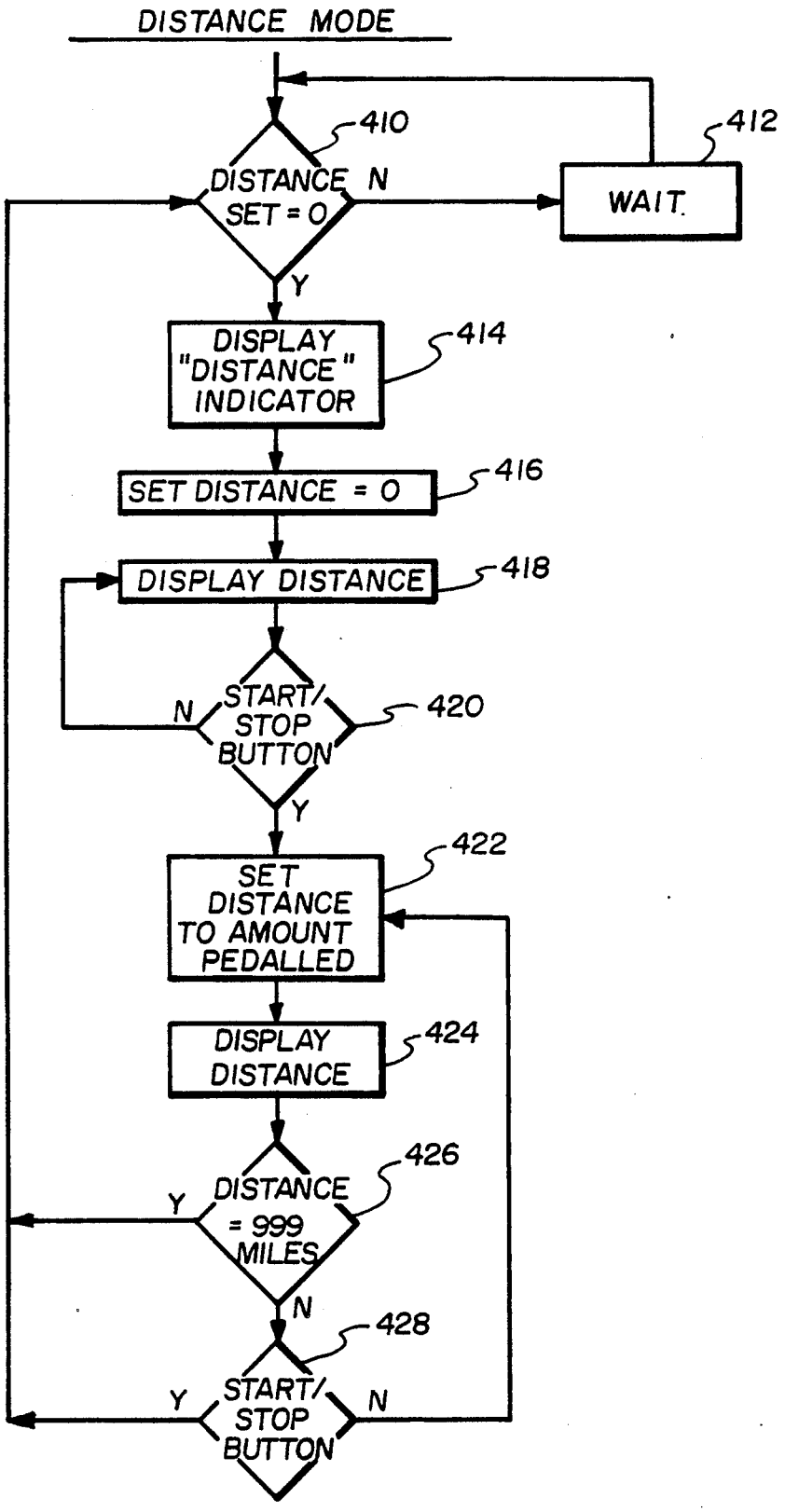
FIG. 11 is a flowchart of a DISTANCE mode program of the invention.

FIG. 11 depicts a program for the DISTANCE mode. The computer begins by asking itself whether the distance set in field 208 is 0 (410). In other words, the computer is asking itself whether the "distance set" mode is still operating. If so, the computer waits and does nothing (412) but continues to ask itself whether the distance set has now reached zero. If the distance set is 0, the computer displays the "distance" indicator in field 226 (414). The computer then sets an internal distance at 0 (416) and displays this 0 distance in field 208 (418). The computer then asks itself whether the "start/stop" button has been pressed (420) and maintains the displayed 0 distance in field 208 while it continues to ask itself this question. If the answer is "yes," the computer calculates a distance travelled based on data received from reed switch 258 and sets the distance to this amount (422). The computer then displays this distance (424).

The computer then asks itself whether the distance has reached 999 miles (426), which is the maximum mileage possible to display at field 208 or whether the "start/stop" button has been pressed (428). If either of these events occur, the program returns to step 410. If neither of these events occur, the computer continues to increment the distance displayed in field 208 to the total distance pedaled.

Figure 12:
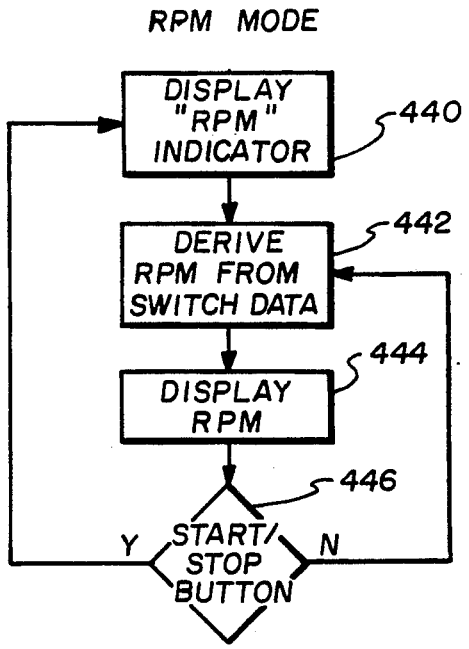
FIG. 12 is a flowchart of an RPM mode program of the invention.

FIG. 12 depicts a program for the RPM mode. The computer displays the "RPM" indicator at field 226 (440). The computer then calculates an RPM value from data it receives from reed switch 258 (442) and displays this RPM value at field 208 (444). The computer then asks itself whether the "start/stop" button has been pressed (446). If so, the computer returns to step 440. If not, the computer maintains the status quo of computing RPM data and displaying this RPM data at field 208.

Figure 13:
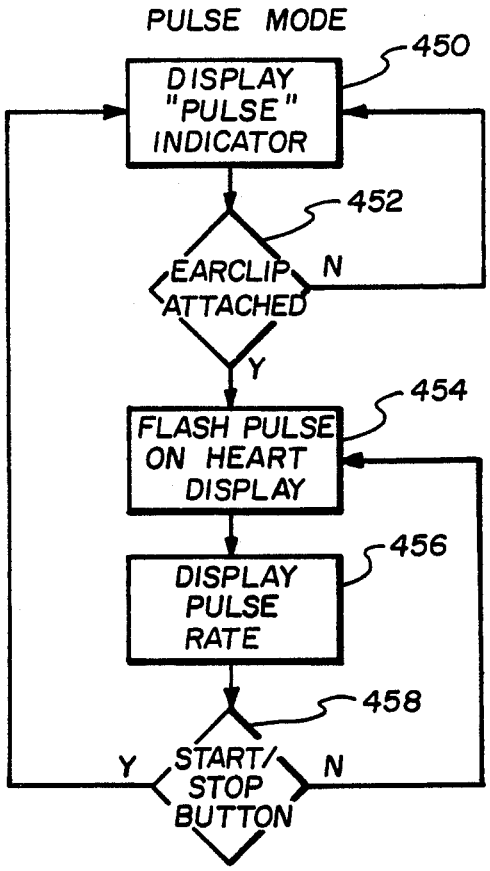
FIG. 13 is a flowchart of a PULSE mode program of the invention.

FIG. 13 depicts a block diagram of programming for the PULSE mode. The computer displays the "pulse" indicator, which is the rectangular indicator with a heart-shaped symbol in field 226 in the third vertical column of indicators from the left (450). The computer then asks itself whether the ear clip 190 is attached (452). If not, the computer maintains status quo and continues to display the pulse indicator. If the answer to test 452 is "yes," the computer flashes the heart-shaped pulse display 212 on and off synchronously with the pulse rate of the user (454). The computer also computes from data received from ear clip 190, a pulse rate of the user and displays this pulse rate at field 208 (456). The computer then asks itself whether the "start/stop" button has been pressed (458). If so, the computer returns to step 450. If not, the computer maintains the status quo of flashing display 212 synchronously with the user's pulse rate and displaying a current numeric pulse rate in field 208.

Figure 14:
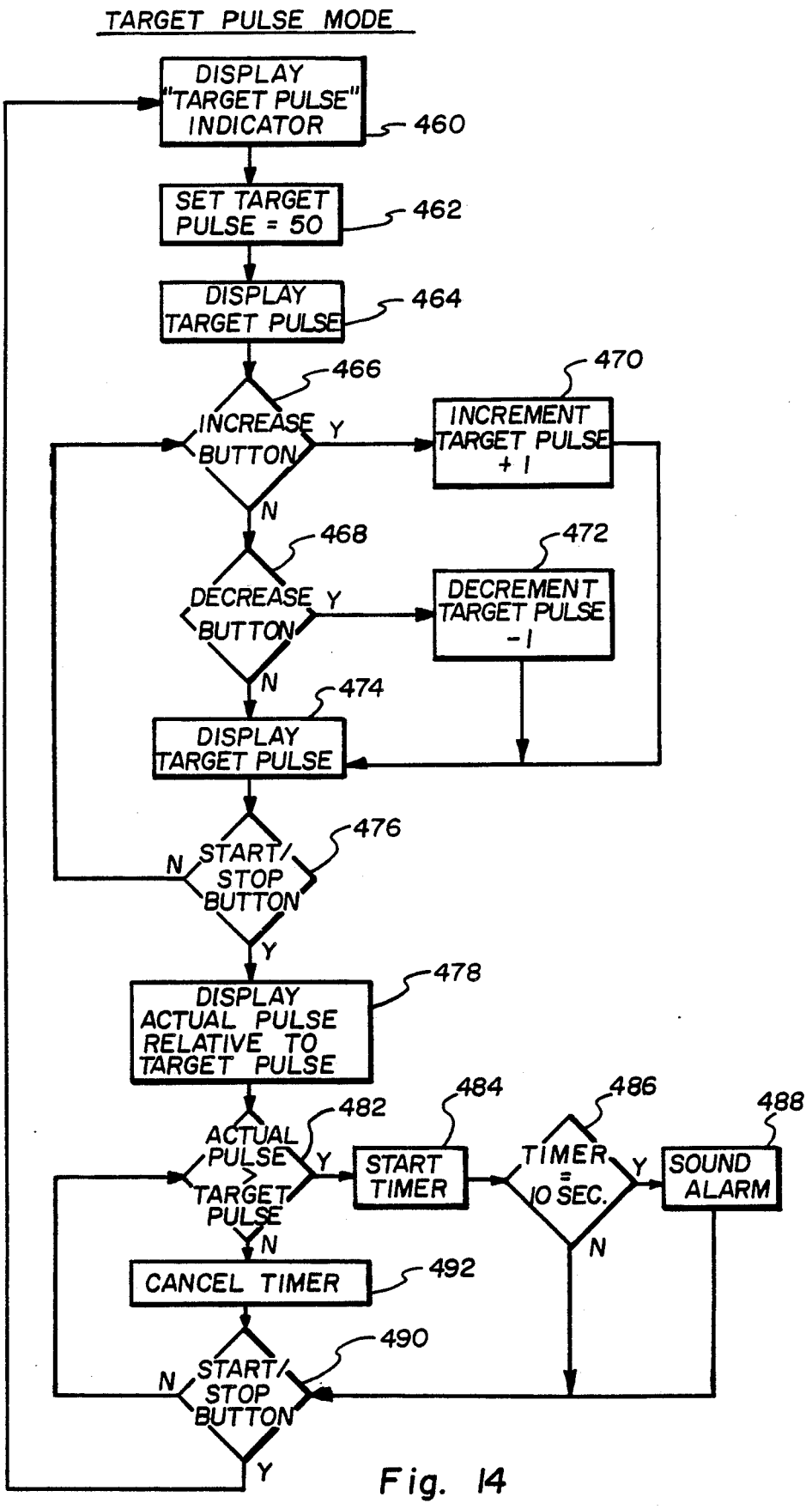
FIG. 14 is a flowchart of a TARGET PULSE mode program of the invention.

FIG. 14 depicts a block diagram of programming for the TARGET PULSE mode. The computer lights the "target pulse" indicator in field 226 (460). The computer then sets an internal target pulse at 50 beats per minute(462) and displays this target pulse in field 208 (464). The computer then looks for an increase or decrease to this target pulse rate by input from increase button 178 or decrease button 180 and displays the selected target pulse in field 208 (466, 468, 470, 472, 474).

The computer then asks itself if the "start/stop" button has been pressed (476). If the answer is "no," the computer continues to look for changes to the target pulse by means of the increase or decrease button and either displays these changes at field 208, or maintains the status quo if neither the increase or decrease button is pressed. If the answer to test 476 is "yes," the computer displays the user's actual pulse relative to the target pulse on plateau graph 218 (478). The computer does this by calculating a pulse rate based on input from ear clip 190. If the actual pulse rate is greater than the target pulse rate, one of the small bars in field 218 is lit to the right of the center of the field. If the actual pulse is less than the target pulse, one of the bars in field 218 to the left of the center of field 218 is lit. The distance to the right or to the left of center at which the bar is lit is proportional to the amount the actual pulse is either greater or less than the target pulse.

The program then runs through a sequence of steps to ask itself whether the actual pulse remains greater than the target pulse for more than 10 seconds. If so, the computer sounds an alarm for the time during which the actual pulse remains above the target pulse greater than the 10 seconds. If at any time the actual pulse falls below the target pulse, the 10 second timer is cancelled (482, 484, 486, 488, 490, and 492). If "start/stop" button is pressed, the program returns to step 460 (490).

Figure 15:
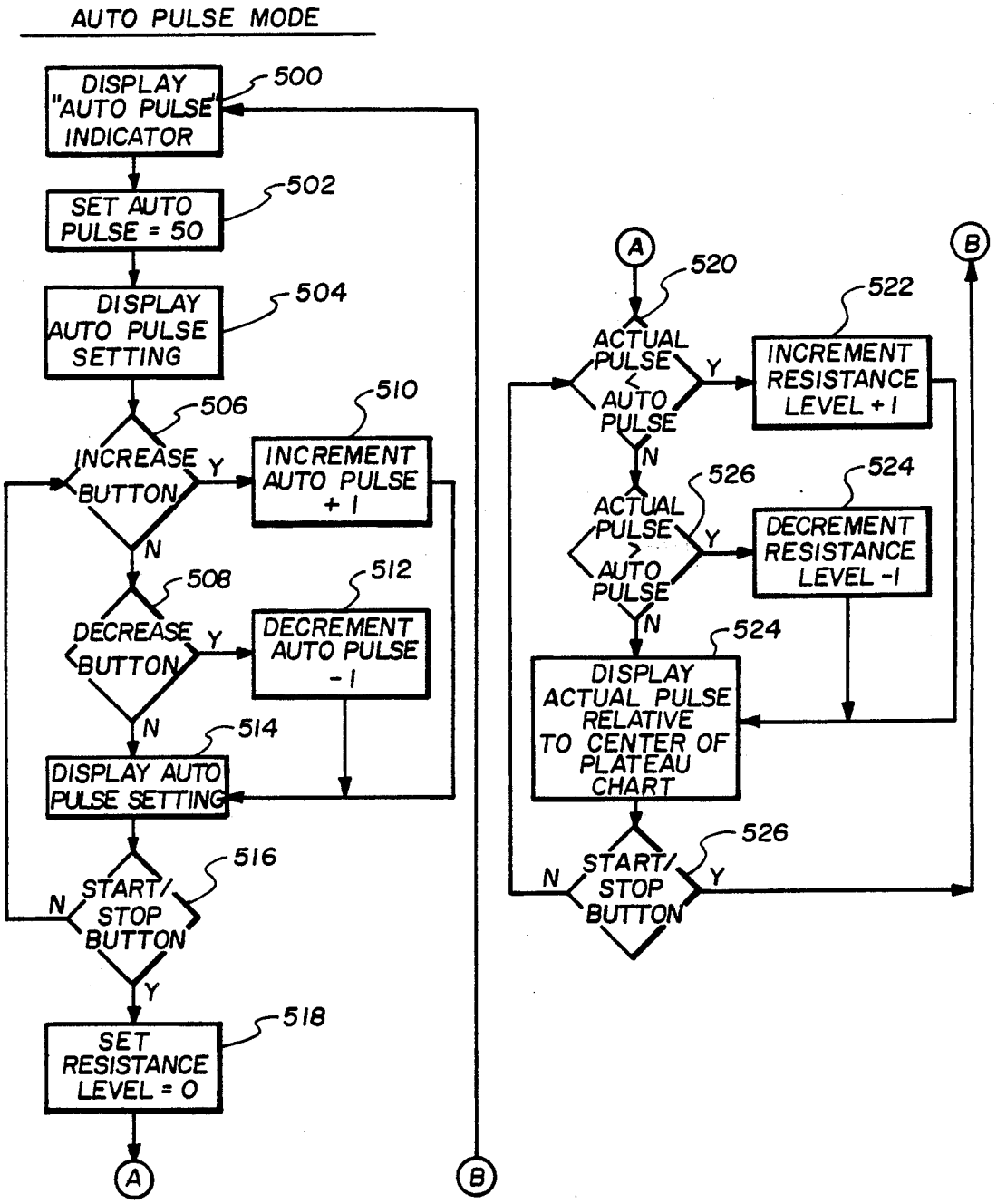
FIG. 15 is a flowchart of an AUTO-PULSE mode program of the invention.

FIG. 15 depicts a block diagram for programming of the AUTO PULSE mode. The program displays the "auto pulse" indicator in field 226 (500). The computer then sets the auto pulse internally at 50 beats per minute (502) and displays this auto pulse setting of 50 in field 208 (504). The computer then asks itself whether the increase button 178 or decrease button 180 has been pressed to either increase or decrease this auto pulse setting according to the selection of the user and to then display the selected auto pulse in field 208 (506, 508, 510, 512, and 514).

After the auto pulse setting is displayed in mode 208, the computer asks if the "start/stop" button has been pressed. If not, the program maintains status quo, displaying the selected auto pulse setting but allowing the user to increase or decrease this setting (516). If the answer to test 516 is "yes," the computer sets a resistance level by means of driver circuit 256 at the 0 level (518).

The computer then asks itself whether the actual pulse of the user calculated from data received at ear clip 190 is less than the auto pulse setting (520). If so, the computer increases the resistance level by one level (522) and displays the user's actual pulse relative to the center of the plateau chart of field 218 (524) to inform the user as to his actual pulse relative to the auto pulse setting he has selected. If the answer to test 520 is negative, the computer asks whether the user's actual pulse is greater than the auto pulse setting (526). If the answer to this test is "yes," the computer decreases the resistance level one level (524) and again displays the actual pulse of the user relative to the center of the plateau chart in field 218 (524). After display of the actual pulse relative to the center in field 218, if the user has not pressed the "start/stop" button (526), the program continues to cycle to ask itself whether the actual pulse is less than or equal to the auto pulse and to increase or decrease the resistance level until the actual pulse is the same as the auto pulse, at which time the actual pulse is displayed in the center bar of field 218. Appropriately clocked timing functions are included to prohibit these adjustments in resistance level from "overshooting" or happening too rapidly to allow the user's pulse rate to change in accordance with the resistance encountered. The increments and decrements at steps 522 and 524 cannot go lower than the 0 resistance level or greater than the highest or 10 resistance level. If at step 526 the user presses the "start/stop" button, the program returns to step 500.

Figure 16:
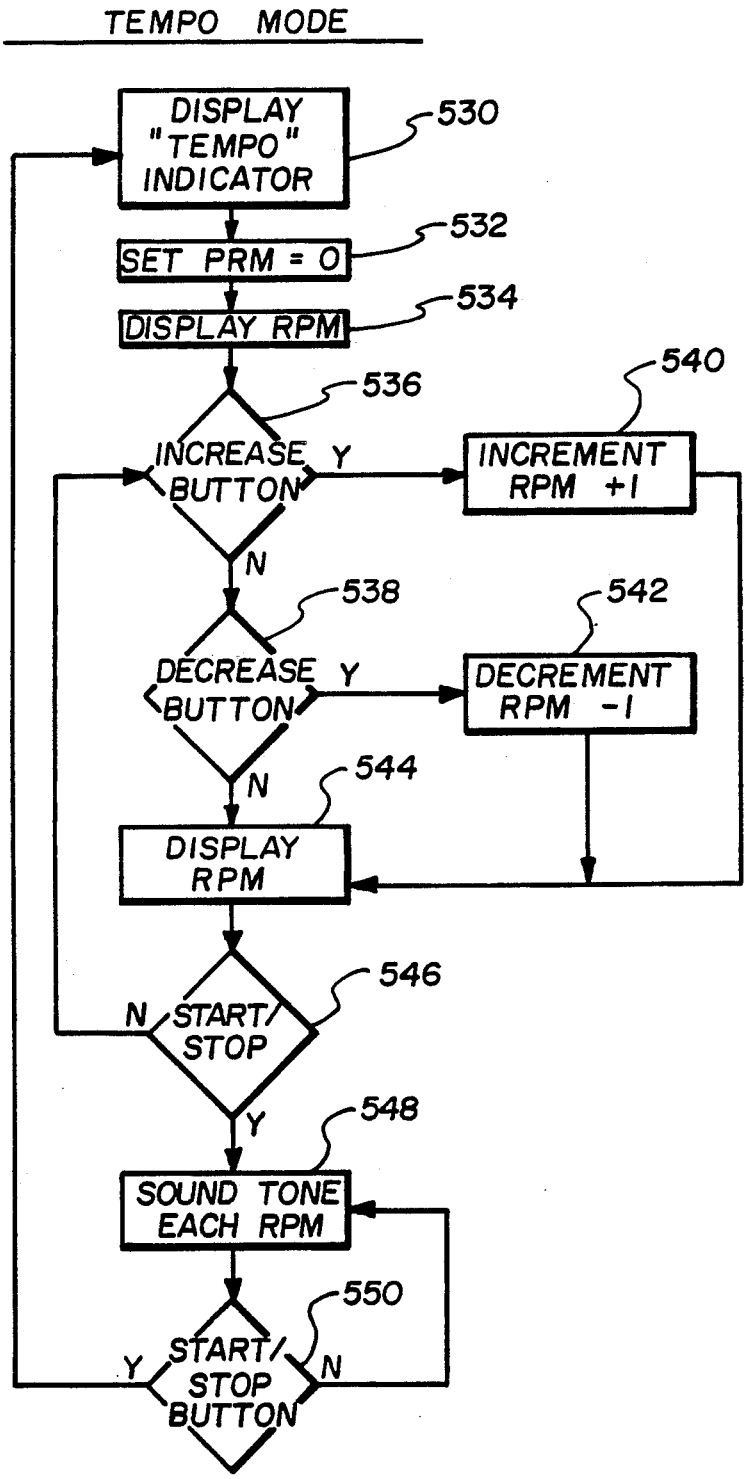
FIG. 16 is a flowchart of a TEMPO mode program of the invention.

FIG. 16 illustrates a block diagram of programming for the TEMPO mode. The computer displays the "tempo" indicator in field 226 (530). The computer then sets an RPM value internally at 0 (532) and displays this 0 RPM value at field 208 (534). The computer then runs through a sequence to allow the user to either increase or decrease this RPM value to a selected RPM value (536, 538, 540, 542, and 544).

The computer looks for the start/stop button (546). If this button is not pressed, the computer continues to allow the user to either increase or decrease the resistance selection displayed at field 208. If the start/stop button is pressed, the computer sounds a tone corresponding to each revolution the user should make to pedals 46 and 48 to achieve the selected RPM value (548). The user listens to this tone and tries to match his revolutions to these tones. In other words, the user may select a particular downstroke with either his right or left foot to correspond to each tone, thereby allowing the user to achieve a selected tempo, the computer providing a metronome-type tempo indicator. The computer continues to look for the start/stop button to be pressed (550). If it is not pressed, the computer allows the status quo continues and to continue to sound the tones according to the selected RPM tempo. If it is pressed, the computer returns to step 530.

Figure 17:
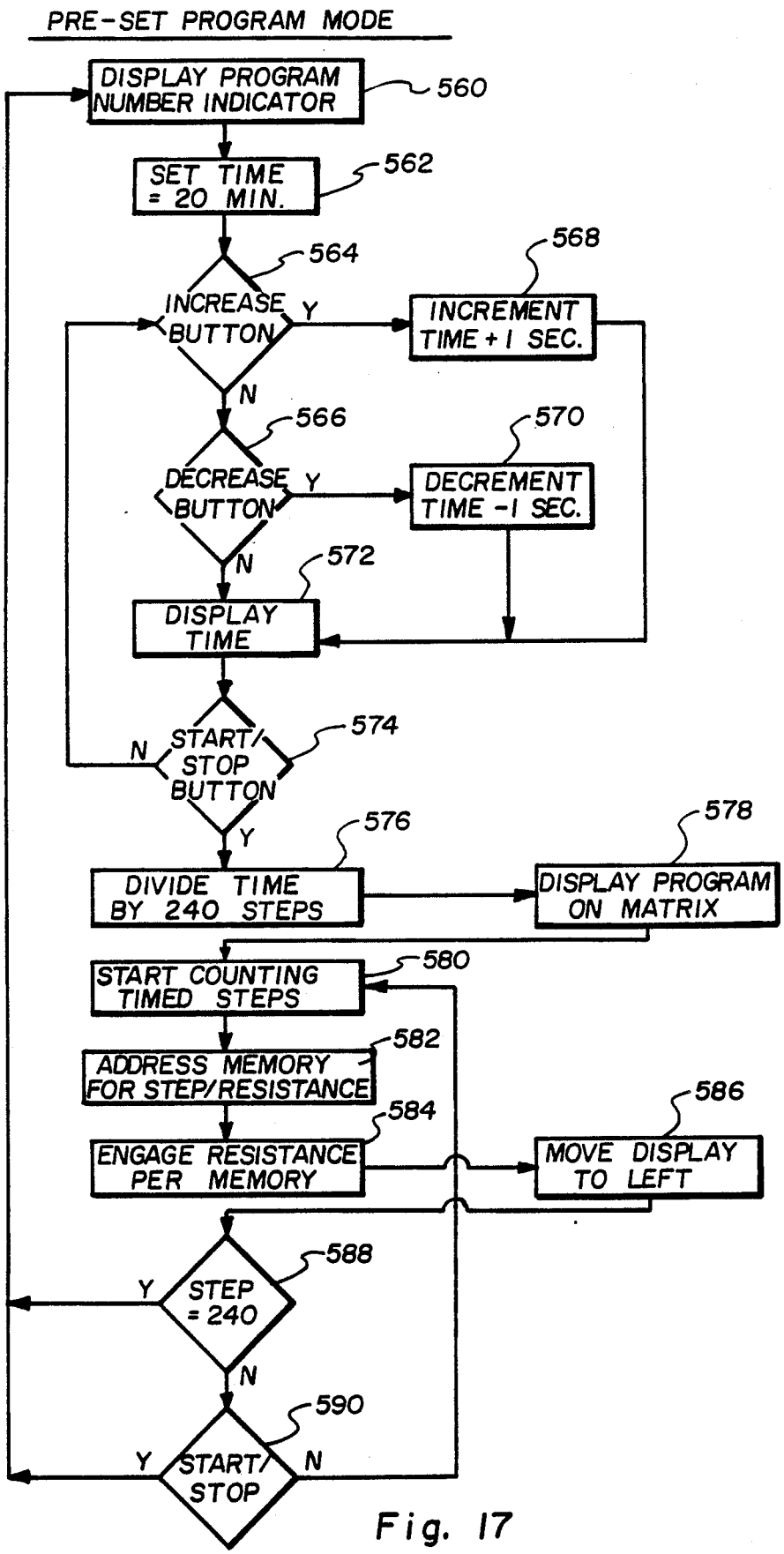
FIG. 17 is a flowchart of PRESET PROGRAM mode of the invention.

FIG. 17 illustrates a block diagram of programming for the PRESET PROGRAMS modes. The program displays the program number indicator of either program 1, program 2, program 3, or program 4 in field 226 (560). The program sets a time internally at 20 minutes for the program duration (562). The program runs through a sequence of steps to allow the user to either increase or decrease this time duration by one second each increment and to display the selected program duration time at field 208 (564, 566, 568, 570, and 572).

The program looks for whether the start/stop button has been pressed (574). If the button is not pressed, the program continues to allow the user or increase or decrease the selected time and to display this selected time at field 208. If the start/stop button is pressed, the program divides the selected time by 240 to create 240 equally-timed steps of the program duration. In other words, the entire program consists of 240 equally-timed steps, the total time of which adds up to the selected program time (576). The computer displays the selected program (578), i.e., program 1, 2, 3, or 5 consisting of an ordered series of resistances on the matrix of field 224, the left-most column being the resistances that will be encountered first. There are 16 vertical columns of bar indicators in the matrix of field 224. Each of these vertical columns represents one step in the program. Therefore, only 15 steps can be displayed at any given time, the remainder the program "feeding" into the right-hand side of field 224 by the computer as one of the steps has been completed and is eliminated from the left-hand side. Thus, the program appears to be moving towards the left to give the user the appearance of travelling over a particular selected terrain. Each vertical column contains 10 rectangular indicators. The numbers of these bar indicators from the bottom indicates the level of resistance from 1 to 10 that will be experienced, the left-hand indicator indicating the relative resistance that will next be experienced by the user.

The computer begins counting the timed steps in chronological order (580). The computer addresses its internal memory for each of these numbered steps to obtain a programmed resistance corresponding to each numbered step (582). The computer then engages the resistance offered to the rotation of flywheel 56 by energizing bidirectional motor 84 accordingly and by reading data from strain gauge 114 (584). The resistance is engaged for the time period for each time interval or step. Once a step has been completed for its selected time interval, the computer moves the displayed program in field 224 one vertical column to the left, the experienced resistance level having been "moved off" the display (586). The computer looks for whether the steps 240, signalling the end of the program (588) or whether the start/stop button has been pressed (590). If either of these events occur, the computer returns to step 560. If not, the computer continues to operate by displaying the program and field 224 and moving the visual display of this program in field 224 to the left.

Figure 18:
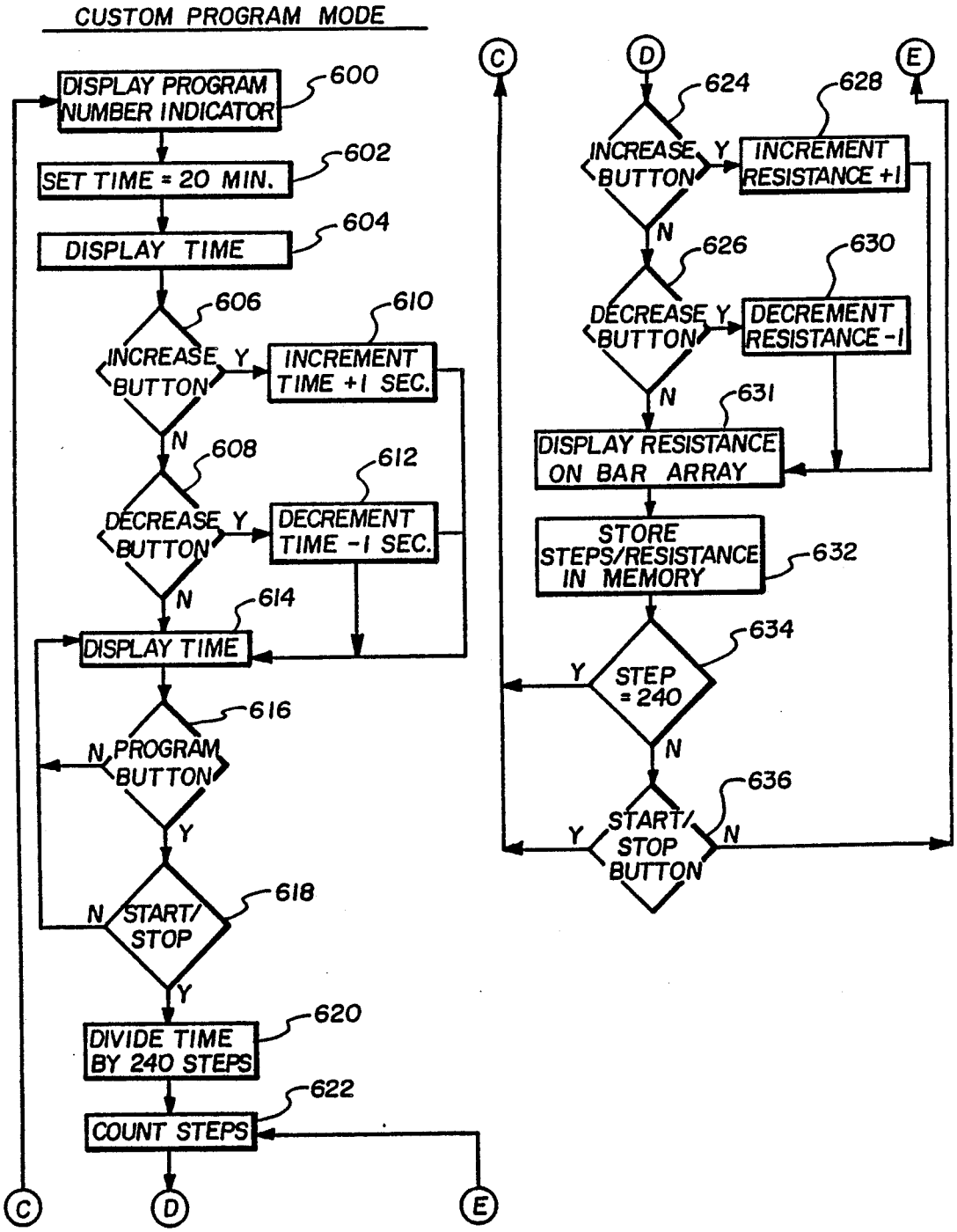
FIG. 18 is a flowchart of CUSTOM PROGRAM mode of the invention.

FIG. 18 illustrates a block diagram of programming for the CUSTOM PROGRAM mode. The computer displays the program indicator number for program 5 or program 6 in field 226. The user presses buttons 174 or 176 to select his desired program number (600). The computer then sets a time duration of this program internally at 20 minutes (602) and displays this time at field 208 (604). The computer then runs through a sequence of steps to ask whether the user has depressed the increase button 178 or decease button 180 to allow the user to either increase or decrease the time duration for the program in increments of one second displays this selected time in field 208 (606, 608, 610, 612, 614).

The computer asks itself whether either the program button 182 or the start/stop button 172 have been depressed (616, 618). If not, the computer continues to display the selected time at field 208. If so, the computer divides the selected program duration by 240 to obtain 240 equally-timed steps (620) and to count the steps off in sequence (622) to allow the user to input into memory an ordered series of resistance intensities corresponding to each of these steps. In other words, the memory is addressed to allow the intensity selected to be input into memory to correspond chronologically with the ordered steps. The user may exercise on the cycle while programming to actually feel the resistance intensity he is programming in, the time duration allowed for the programming corresponding to the selected time it has been displayed at field 208. The computer runs through a sequence to allow the user to increase or decrease the resistance by one level in each increment and to start the resistance in memory corresponding to the current step as the computer counts in a timed fashion through the steps during the selected time duration (624, 626 and 628, 630, 632).

The computer looks for whether the step has reached 240, signalling the end of the program duration, or whether the start/stop button has been pressed (634 636). If so, the program returns to step 600. If not, the program continues to count through the steps in timed fashion and to allow the user to either increase or decrease resistance and to store these resistances in memory corresponding to the current step as described.

Figure 19:
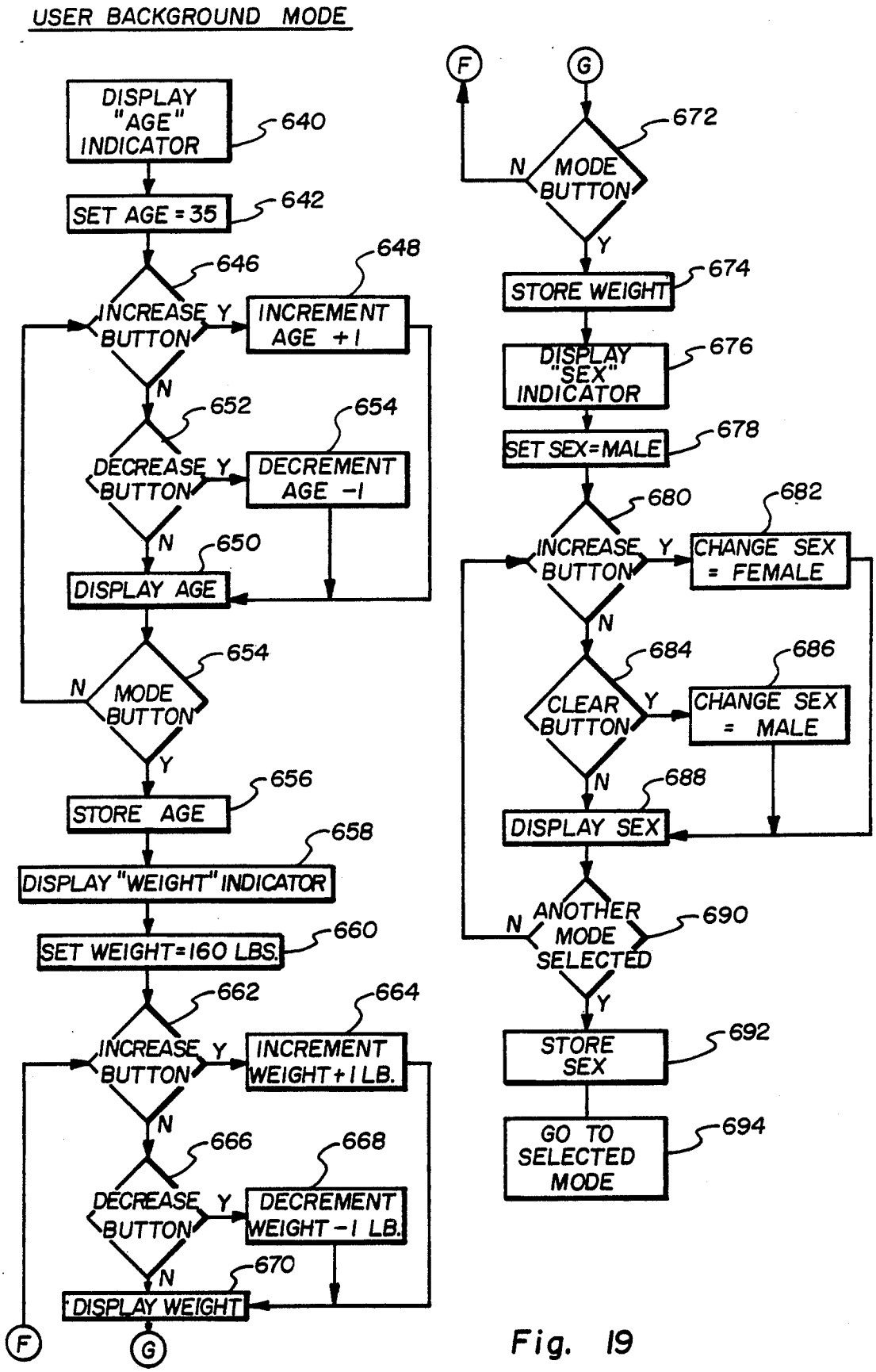
FIG. 19 is a flowchart of a BACKGROUND INFORMATION program of the invention.

FIG. 19 illustrates a block diagram of programming for a USER BACKGROUND mode. The computer displays the "age" indicator at field 226 (640). The computer then sets the age internally at 35 years old (642) and to display this age at field 208 (644). The program then runs through a sequence to allow the user to increase or decrease the selected age and to display the selected age at field 208 (646, 648, 650, 652, and 654).

The computer then asks itself whether one of the mode selection buttons 174 or 176 is depressed (654). If not, the computer continues to allow the user to increase or decrease the selected and displayed age. If a mode button is pushed, the computer stores the selected age in memory (656).

At this time, the user must depress the mode keys 174 and 176 until the "weight" indicator is lit at field 226 to indicate to the user that weight selection for background information is possible (658). The program sets the weight internally at 160 pounds and displays this value at field 208 (660). The program then runs through a sequence to allow the user to increase or decrease this weight value to conform to his own weight and to display the selected weight at field 208 (662, 664, 666, 668, and 670).

The program looks for whether the mode button has now been selected (672). If not, the program continues to allow the user to increase or decrease the selected weight and to display this weight at field 208. If a mode button 174 or 176 has pressed, the computer stores the displayed weight in memory as background information for the user (674). The user, to store his sex or gender information, is to have pushed one of the mode buttons until the "sex" indicator in field 226 is lit. The computer lights this indicator 676 to indicate to the user that he can now select the appropriate sex. The computer sets the sex internally at "male" (678) and displays an M in the array of field 224. The computer then runs through a sequence to allow the user to use the increase or decrease buttons 156 and 158 to change between male and female and to display the selection in field 224 (680, 682, 684, 686, and 688).

The computer then asks itself if another mode has been selected, in other words, whether the user has depressed one of the mode buttons 174 or 176 (690). If not, the computer continues to allow the computer to select between male and female and to display this selection at field 208. If another mode has been selected, the computer stores the displayed sex in memory as background information (692) and goes to the selected mode (694).

Figure 20:
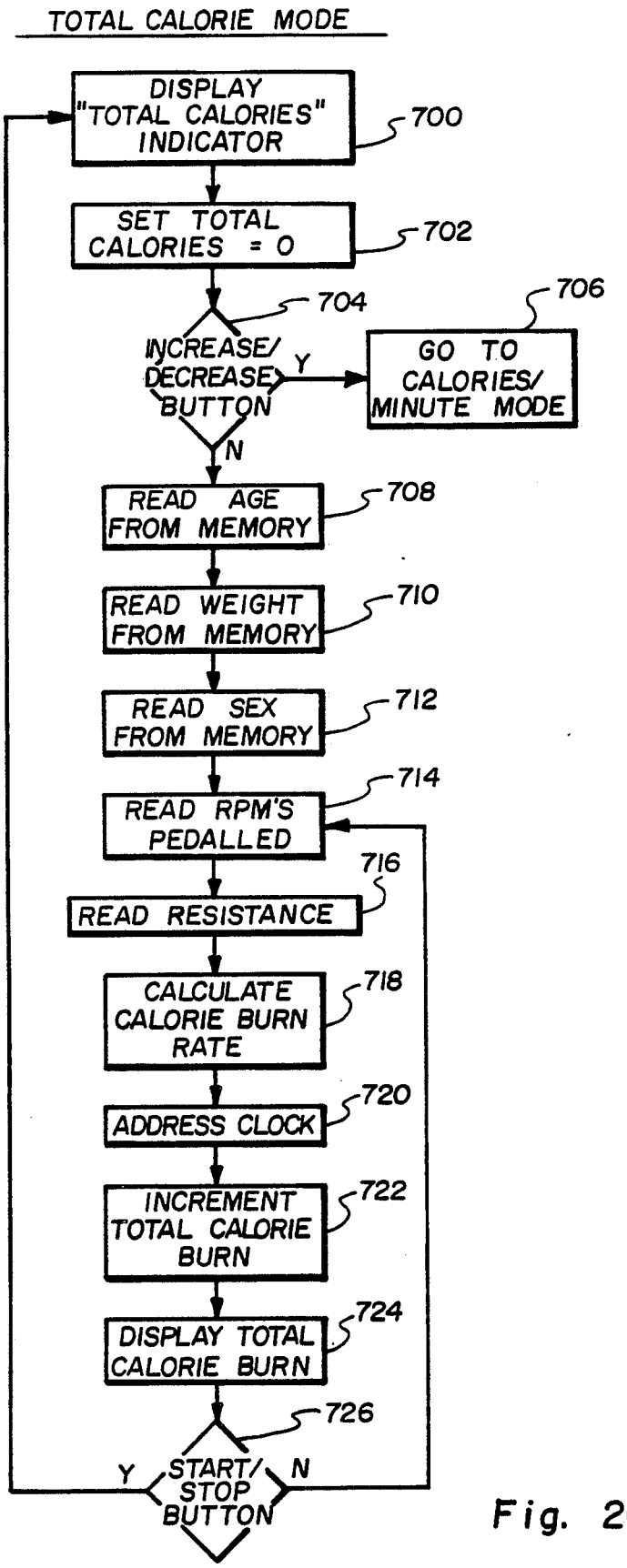
FIG. 20 is a flowchart of a TOTAL CALORIES program of the invention.

FIG. 20 illustrates a block diagram of programming for the TOTAL CALORIES mode. The program displays the "total Calories" indicator in field 222 (700). The program then sets the total Calories equal to 0 internally (702). The computer asks itself if the increase button has been selected (704). If so, the computer goes to the CALORIES PER MINUTE mode (706) described in reference to FIG. 21 hereafter. If not, a program reads the age stored by the user from memory (708), reads the weight of the user stored in memory (710), and reads the sex stored in memory (712). The computer then reads data from reed switch 258 to calculate the revolutions per minute that the cycle is being pedaled (714), and reads a resistance level from strain gauge 114 (716). Based on the age, weight, sex, RPM's, and resistance, the computer calculates a Calorie burn rate for the user while he is exercising on the exercise cycle (718).

The computer calculates this Calorie burn rate based on a polynomial developed for the particular exercise cycle. This polynomial is developed empirically by testing persons of various ages, weight and of both sexes for Calorie usage while pedaling on the cycle at various RPM's and at various resistances. The actual Calorie burn rate measured in such tests for the development of these polynomials is obtained on a basis of oxygen usage by the user. Oxygen use is an indicator of Caloric burn rate.

The computer addresses a clock (720) to convert the Calorie burn rate information into a total Calorie use for that particular exercise session and to continually increment this Calorie burn (722) and to display the Calorie burn in field 220 (724).

The computer looks for whether the start/stop button has been pressed (726). If it has, the computer returns to display the "total Calories" indicator. If not, the computer continues to read the RPM's pedaled and resistance experienced to combine with the user background information to calculate Calorie burn rate and total Calorie burn information, as described.

Figure 21:
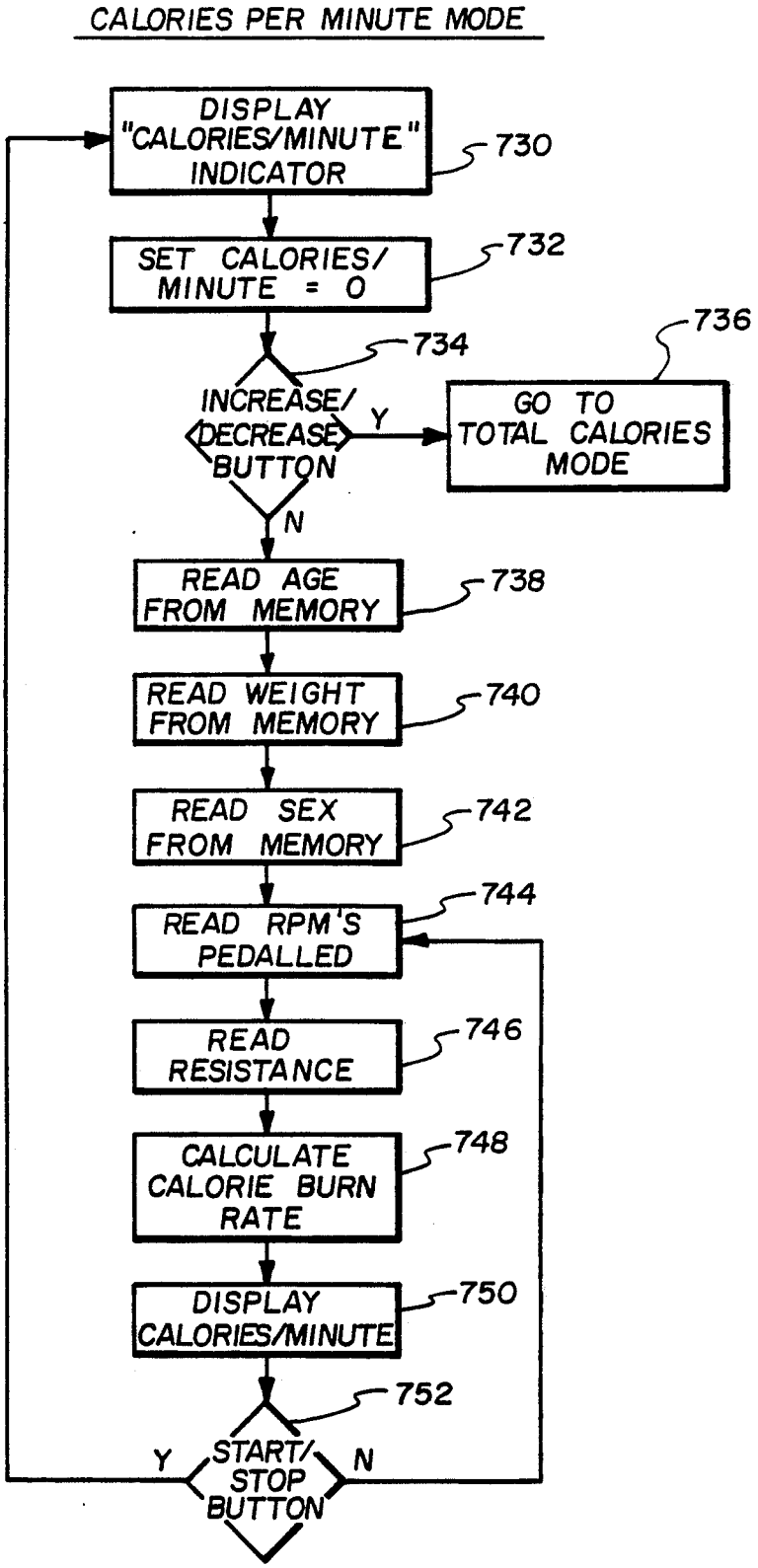
FIG. 21 is a flowchart of a CALORIES PER MINUTE program of the invention.

FIG. 21 illustrates a block diagram of programming for the CALORIE PER MINUTE mode. The program displays the "Calorie/minute" indicator at field 222 (730). The computer sets the Calorie per minute internally at 0 (732). The computer asks itself whether the increase or decrease button is selected (734). If so, the computer goes to the TOTAL CALORIES mode described in reference to FIG. 20 (736). If not, the computer reads the user's age from memory (738), reads the user's weight from memory (740), and reads the user's sex from memory (742). The computer also reads the RPM data from reed switch 258 to calculate an RPM value (744) and reads data from strain gauge 114 to derive a resistance value (746). Based on the user's age, weight, sex, RPM's pedaled and resistance offered by the cycle, the computer calculate a Calorie burn rate in terms of Calories per minute (748). The computer displays this Calories per minute value at field 220 (750). The computer asks itself whether the start/stop button has been pressed (752). If so, computer returns to step 730. If not, the computer continues to read current RPM and resistance values and the user's age, weight and sex background information to calculate a current Calorie per minute value and to display this value at field 220.

Reference herein to details of the illustrated embodiment is not intended to limit the scope of the appended claims, which themselves recite those features regarded as important to the invention.

What is claimed:

1. A computerized exercise machine comprising:

an exercise structure having a movable member for movement by a user to exercise on said exercise structure;

resistance means associated with said movable member to resist the movement of said movable member;

adjustment means mechanically associated with said resistance means for selectively varying the amount of resistance of said resistance means;

resistance sensing means associated with said resistance means for sensing work performed by said user in moving said movable member against said resistance and including: a resistance responsive element connected to said resistance means, said resistance responsive element undergoing deformation in response to changes in the amount of resistance offered by said resistance means; and a piezoelectric element physically adapted to said resistance responsive element, said piezoelectric element being responsive to said deformation to translate said deformation to an electrical resistance signal; a motion sensor mounted to said exercise structure to sense the rate of movement of said movable member and to provide a movement rate signal reflective thereof; computer means associatively linked with said adjustment means for selectively controlling said adjustment means and communicatively linked to said resistance sensing means and said motion sensor to receive said resistance signal and said movement rate signal therefrom; pulse data input means connected between said user and said computer means for supplying pulse data to said computer means from said user exercising on said structure; input means connected to said computer means for receiving background data from said user and for selecting an exercise program and at least one exercise parameter related to said selected program; and display means mounted on said exercise structure and associatively linked with said computer means for displaying data computed by said computer means; wherein said computer means is operable to receive said selected exercise program including varying said amount of resistance of said resistance means selected by said user from said input means, to control said adjustment means in accordance with said selected exercise program and said varying amount of resistance over a preselected program duration, to read said pulse data from said pulse data input means, to read a user-selected target pulse rate from said input means, to compute said varying amount of resistance to cause said user's pulse to approach said target pulse rate and in turn to control said adjustment means to change the resistances to said varying amount of resistance, to read said background data from said input means, to read the rate of movement of said movable member from said movement sensor, to read the resistances of said resistance means from said resistance sensing means, and to compute therefrom calorie use data.

2. The computerized exercise machine according to claim 1 further including audio signal means connected to said computer means to receive audio signals therefrom to generate aural signals, wherein said input means is further operable to receive a user-selected movement frequency, and wherein said audio signal means includes a tempo indicator operable to supply one of said aural signals to said user to move said movable member at intervals corresponding to said selected movement frequency.

3. The computerized exercise machine according to claim 2 wherein said audio signal means is associatively linked with said pulse data input means and is further operable to sound a tone when the pulse data exceeds said target pulse rate for more than a preselected time.

4. The computerized exercise machine of claim 2 wherein said display means includes graphical representations of exercise parameters, said graphical representations comprising arrays of indicators.

5. The computerized exercise machine of claim 4 wherein said graphical representations include a target pulse display comprising a series of indicators arranged substantially in a linear direction having a center group of indicators corresponding to said target pulse rate specified by said selected program, a first group of indicators each corresponding to different pulse increments lower than said target pulse rate, and a second group of indicators each corresponding to different pulse increments greater than said target pulse value, said first and second groups of indicators being respectively disposed on opposite sides of said center group of indicators, and each of said indicators being activated when said pulse data corresponds to the pulse value represented by each of said indicators and deactivated when it does not.

6. The computerized exercise machine of claim 4 wherein said selected program include a target pulse mode, said user selects said target pulse mode and a desired target pulse rate via said input means, said computer means controls said target pulse display according to said pulse data received from said pulse data input means to display said pulse data relative to said target pulse rate in response to which the user extemporaneously adjusts said exercise movements to cause said pulse data to match said target pulse rate.

7. The computerized exercise machine of claim 4 wherein said computer means is further operable to divide said preselected program duration into a preselected number of time steps and to control said adjustment means to chronologically vary the amount of resistance of said resistance means according to a sequence of resistance values specified for said time steps in said selected program.

8. The computerized exercise machine of claim 7 wherein said display means further includes a graphical program matrix display comprising indicators disposed in multiple columns, said columns arranged adjacent, spaced horizontally from one another, and each one of said columns representing one of said time steps, wherein each indicator in a column corresponds to a selected resistance and is activated when said column receives resistance display signals from said computer means corresponding to said resistance signal from said resistance sensing means, said computer means providing said resistance display signals to each of said columns in an order corresponding to said sequence of resistance values, whereby said matrix display represents a segment of said sequence of resistance values specified in said selected program.

9. The computerized exercise machine of claim 8 wherein said computer means varies said display signals to said columns in chronological coordination with said time steps to cause the leftmost of said columns to display the resistance value specified by the next time step of said selected program and the resistance values of succeeding time steps in order according to said selected program.

10. The computerized exercise machine according to claim 1 wherein said resistance responsive element undergoes said deformation proportional to the amount of said work performed by said user.

11. A computerized exercise cycle, comprising:

a cycle structure adapted to be operated by a user and presenting a pair of pedals for rotation by the feet of said user;

resistance means mechanically associated with said pedals for offering an adjustable amount of resistance to the rotation of said pedals;

resistance means operably associated with said resistance means and including: a resistance responsive element connected to said resistance means deformatable in response to changes in the amount of resistance offered by said resistance means; and a sensing element physically adapted to said resistance responsive element, said sensing element being responsive to said deformation to generate resistance signal reflective of said deformation;

adjustment means mechanically associated with said resistance means for varying said adjustable amount of resistance;

computer means mounted to said cycle structure, associatively linked with said adjustment means for controlling said adjustment means and communicatively linked to receive said resistance signal from said resistance sensing means;

input means associated with said cycle structure and communicatively linked with said computer means for receiving data from said user;

display means associated with said cycle structure and communicatively linked with said computer means for providing visible and audio information signals to said user operating said cycle structure;

said computer means being operable to:

receive one of a plurality of programs selectable by said user from said input means, each one of said plurality of programs including a resistance subprogram consisting of an ordered set of user selectable resistance, control said adjustment means to vary the adjustable amount of resistance of said resistance means to the rotation of said pedals in accordance with said selected program over a user-selected program duration, control said display means to provide displays including visible display for providing said visible information signals representative of said adjustable amount of resistances of said selected program and audio display for providing said audio information signals representative of said selected program, and to compute calorie use information from said resistance signal and said user data.

12. The computerized exercise cycle according to claim 11 wherein said computer means is further operable to: read the selection of an automatic pulse mode by said user from said input means;

receive a target pulse rate from said user by said input means; and control said adjustment means to adjust said amount of resistance of said resistance means in a computed fashion to cause the user's pulse rate to approach said target pulse rate.

13. The computerized exercise cycle according to claim 11, wherein said visible display include graphical representations comprising arrays of indicators.

14. The computerized exercise cycle of claim 13, wherein said graphical representations include a target pulse display comprising a series of indicators arranged substantially in a linear direction having a center group of indicators corresponding to said target pulse rate specified by said selected program, a first group of indicators each corresponding to different pulse increments lower than said target pulse rate, and a second group of indicators each corresponding to different pulse increments greater than said target pulse rate, said first and second groups of indicators being respectively disposed on opposite sides of said center group of indicators, and each of said indicators being activated when said pulse data corresponds to the pulse value represented by each of said indicators and deactivated when it does not; and said selected program include a target pulse mode in which said user selects said target pulse rate via said input means, said computer means controls said target pulse display according to said pulse data from said pulse data input means to display said pulse data relative to said target pulse rate in response to which the user extemporaneously adjusts said exercise to cause said pulse data to match said target pulse rate.

15. The computerized exercise machine of claim 13 wherein said computer means is further operable to divide said selected program duration into a preselected number of time steps and to control said adjustment means to chronologically vary the amount of resistance offered by said resistance means according to a sequence of resistance values specified for said time steps in said selected program, and wherein said display means further includes a graphical program matrix display comprising indicators disposed in multiple columns, said columns arranged adjacent, spaced horizontally from one another, and each one of said columns representing one of said time steps, wherein each indicator in a column corresponds to an individual resistance value and is activated when said column receives resistance display signals from said computer means corresponding to said individual resistance value, said computer means providing said resistance display signals to each of said columns in an order corresponding to said sequence of resistance values, whereby said matrix display represents a segment of said sequence of resistance values specified in said selected program.

16. The computerized exercise cycle of claim 15 wherein said computer means varies said display signals to said columns in chronological coordination with said time steps to cause the leftmost of said columns to display the resistance value specified by the next time step of said selected program and the resistance values of succeeding time steps in order according to said selected program.

17. The computerized exercise cycle according to claim 11 wherein said input means is further operable to receive a frequency of movement selected by said user; and said audio information signals include a tempo signal to signal said user to rotate said pedals at intervals corresponding to said selected frequency of movement.

18. A computerized exercise machine comprising:

an exercise structure having a movable member for movement by a user to exercise on said exercise structure;

resistance means associated with said movable member to resist the movement of said movable member;

adjustment means mechanically associated with said resistance means for selectively varying the resistance of said resistance means;

resistance sensing means associated with said resistance means for sensing work performed by said user in moving said movable member against said resistance and including:

a resistance responsive element connected to said resistance means, said resistance responsive element undergoing deformation in response to changes in the resistance of said resistance means; and a piezoelectric element adapted to said resistance responsive element, to generate a resistance signal reflective of said deformation;

a motion sensor mounted to said exercise structure to sense the rate of movement of said movable member and to provide a movement rate signal reflective thereof;

computer means associatively linked with said adjustment means for selectively controlling said adjustment means and communicatively linked to said resistance sensing means and said motion sensor to receive said resistance signal and said movement rate signal therefrom;

input means connected to said computer means for receiving background data from said user and for selecting an exercise program and at least one exercise parameter related to said selected program;

display means mounted on said exercise structure and associatively linked with said computer means for displaying data computed by said computer means;

wherein said computer means is operable to receive said selected exercise program and varying the resistance of said resistance means selected by said user from said input means, and control said adjustment means in accordance with said selected exercise program and said varying resistance over a preselected program duration, read said background data from said input means, read the rate of movement of said movable member from said motion sensor, read the resistance of said resistance means from said resistance sensing means, and compute calorie use data from said background data, rate of movement, and resistances.

* * * * *

UNITED STATES PATENT AND TRADEMARK OFFICE

CERTIFICATE OF CORRECTION

PATENT NO. : 5,067,710

DATED : NOVEMBER 26, 1991

INVENTOR(S) : SCOTT R. WATTERSON, ET AL.

It is certified that error appears in the above-identified patent and that said Letters Patent is hereby corrected as shown below:

| | |
|---|---|
| COL. 8, LINE 44 | Change "52" to ---152---. |
| Col. 11, line 46 | Insert a comma (,) after "putes". |
| Col. 17, line 14 | Insert ---exercise--- before "struc-" |
| Col. 18, line 11 | Change "include" to ---includes---. |

| | |
|---|---|
| Col 7, line 54 | Change "recognized" to ---recognize---. |
| Col. 10, line 44 | Change "the" to ---then---. |
| Col. 13, line 27 | Change line so it reads ---lows the status quo to continue and continues to sound---. |
| Col. 13, line 43 | Change "or" to ---to---. |
| Col. 13, line 58 | Insert ---of--- after "reminder". |
| Col. 14, line 48 | Change "it" to ---which---. |
| Col. 15, line 24 | Insert ---been--- after "has". |
| Col. 16, line 33 | Change "calculate" to ---calculates---. |
| Col. 16, line 37 | Insert ---the--- after "If so," |

Signed and Sealed this

Twelfth Day of July, 1994

*Attest:*

*Attesting Officer*

BRUCE LEHMAN

*Commissioner of Patents and Trademarks*